US009353653B2

(12) United States Patent
Hayashi

(10) Patent No.: US 9,353,653 B2
(45) Date of Patent: May 31, 2016

(54) VALVE TIMING ADJUSTING APPARATUS

(71) Applicant: DENSO CORPORATION, Kariya, Aichi-pref. (JP)

(72) Inventor: Masashi Hayashi, Okazaki (JP)

(73) Assignee: DENSO CORPORATION, Kariya (JP)

( * ) Notice: Subject to any disclaimer, the term of this patent is extended or adjusted under 35 U.S.C. 154(b) by 29 days.

(21) Appl. No.: 14/549,617

(22) Filed: Nov. 21, 2014

(65) Prior Publication Data

US 2015/0144084 A1 May 28, 2015

(30) Foreign Application Priority Data

Nov. 22, 2013 (JP) ..... 2013-241660
Sep. 22, 2014 (JP) ..... 2014-192387

(51) Int. Cl.
*F01L 1/34* (2006.01)
*F01M 1/14* (2006.01)
*F01M 1/16* (2006.01)

(52) U.S. Cl.
CPC .. *F01L 1/34* (2013.01); *F01M 1/14* (2013.01); *F01M 1/16* (2013.01)

(58) Field of Classification Search
CPC ..... F01L 1/34; F01M 1/14; F01M 1/16
USPC ..... 123/90.15, 90.17
See application file for complete search history.

(56) References Cited

U.S. PATENT DOCUMENTS 8,904,980 B2 * 12/2014 Hayashi et al. ..... F01L 1/344 123/90.15
2014/0090612 A1 4/2014 Hayashi et al.

FOREIGN PATENT DOCUMENTS

JP 2005-351182 12/2005

* cited by examiner

*Primary Examiner* — Ching Chang
(74) *Attorney, Agent, or Firm* — Nixon & Vanderhye P.C.

(57) ABSTRACT

A vane rotor includes a laminated portion and seal portions. The laminated portion includes a plurality of metal plates, which are stacked in an axial direction. The seal portions are placed on two axially opposite sides of each of an advancing port, a retarding port, and a supply port. Each seal portion is configured into an annular form to extend along an outer peripheral surface of a sleeve in a circumferential direction and is engaged with the laminated portion to limit deformation of the seal portion toward a radially outer side. The seal portion is made of a material that has a thermal expansion coefficient, which is larger than a thermal expansion coefficient of a material of each metal plate.

8 Claims, 16 Drawing Sheets

VALVE TIMING ADJUSTING APPARATUS

CROSS REFERENCE TO RELATED APPLICATION

This application is based on and incorporates herein by reference Japanese Patent Application No. 2013-241660 filed on Nov. 22, 2013 and Japanese Patent Application No. 2014-192387 filed on Sep. 22, 2014.

TECHNICAL FIELD

The present disclosure relates to a valve timing adjusting apparatus.

BACKGROUND

A known valve timing adjusting apparatus includes a housing, which is rotated integrally with a crankshaft of an internal combustion engine, and a vane rotor, which is rotated integrally with a camshaft. Such a valve timing adjusting apparatus adjusts valve timing of intake valves or exhaust valves by changing a rotational phase of the vane rotor relative to the housing. The rotational phase of the vane rotor is changed by supplying working oil to advancing chambers or retarding chambers defined in the housing. For example, JP2005-351182A discloses a vane rotor that includes a plurality of metal plates, which are stacked one after another in an axial direction.

The inventor of the present application has proposed to place an oil pressure control valve, which supplies working oil to the advancing chambers or the retarding chambers, in a center portion of the vane rotor that has the laminated portion made of the metal plates. In such a case, an inner peripheral wall surface of the vane rotor seals between corresponding adjacent ports of a sleeve of the oil control valve.

However, an inner diameter of the vane rotor tends to vary from product to product due to, for example, displacement of the metal plates relative to each other. Thus, it is required to set a relatively large clearance between the inner peripheral wall surface of the vane rotor and an outer peripheral wall surface of the sleeve to enable insertion of the sleeve into the vane rotor. Therefore, a sealing performance for sealing between the ports of the sleeve may possibly be deteriorated to cause an increase in leakage between the ports of the sleeve. The increase in the leakage between the ports of the sleeve may cause deterioration in an operational speed of the vane rotor and deterioration in a holding performance for holding the rotational phase of the vane rotor relative to the housing.

SUMMARY

The present disclosure addresses the above disadvantages.

According to the present disclosure, there is provided a valve timing adjusting apparatus that is placed in a drive force transmission path for transmitting a drive force from a driving-side shaft of an internal combustion engine to a driven-side shaft and adjusts valve timing of at least one of an intake valve and an exhaust valve driven by the driven-side shaft. The valve timing adjusting apparatus includes a housing, a vane rotor, a sleeve, and a spool. The housing is rotatable integrally with one of the driving-side shaft and the driven-side shaft. The vane rotor is received in the housing and is rotatable integrally with the other one of the driving-side shaft and the driven-side shaft. The vane rotor has a vane, which partitions a corresponding inner space of the housing into an advancing chamber and a retarding chamber. The vane rotor includes an advancing oil passage, a retarding oil passage, and a supply oil passage. The advancing oil passage is communicated with the advancing chamber. The retarding oil passage is communicated with the retarding chamber. The supply oil passage is communicatable with an external oil supply source. The sleeve is configured into a tubular form and extends in an axial direction at a center portion of the vane rotor. The sleeve includes an advancing port, a retarding port, and a supply port. The advancing port is communicated with the advancing oil passage. The retarding port is communicated with the retarding oil passage. The supply port is communicated with the supply oil passage. The spool is displaceable in the axial direction in an inside of the sleeve. The spool connects between the supply port and the advancing port when the vane rotor is rotated to an advancing side relative to the housing. The spool connects between the supply port and the retarding port when the vane rotor is rotated to a retarding side relative to the housing. The vane rotor includes a laminated portion and a seal portion. The laminated portion includes a plurality of metal plates, which are stacked in the axial direction. The seal portion is placed on at least one of two axially opposite sides of at least one of the advancing port, the retarding port, and the supply port and is configured into an annular form to extend along an outer peripheral surface of the sleeve in a circumferential direction. The seal portion is engaged with the laminated portion to limit displacement or deformation of the seal portion toward a radially outer side and is made of a material that has a thermal expansion coefficient, which is larger than a thermal expansion coefficient of a material of each of the plurality of metal plates.

BRIEF DESCRIPTION OF THE DRAWINGS

The drawings described herein are for illustration purposes only and are not intended to limit the scope of the present disclosure in any way.

DETAILED DESCRIPTION

Figure 1:
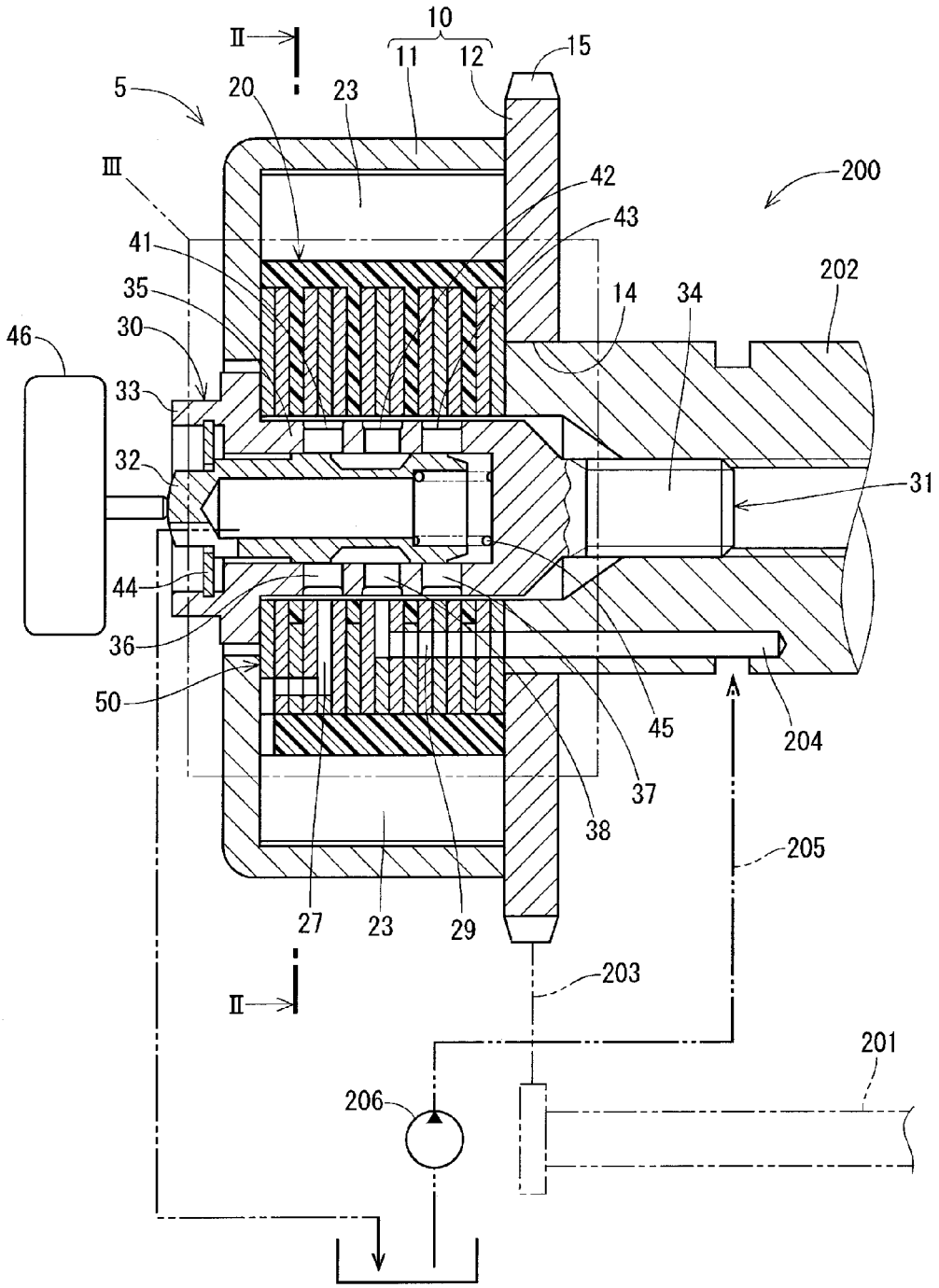
FIG. 1 is a cross-sectional view showing a schematic structure of a valve timing adjusting apparatus according to a first embodiment of the present disclosure.

Various embodiments of the present disclosure will be described with reference to the accompanying drawings. In the following discussion of the embodiments, similar components will be indicated by the same reference numerals and will not be described redundantly for the sake of simplicity.

First Embodiment

FIG. 1 shows a valve timing adjusting apparatus according to a first embodiment of the present disclosure. The valve timing adjusting apparatus 5 adjusts valve timing of intake valves (not shown), which are driven to open and close the same by a camshaft 202. Specifically, the valve timing adjusting apparatus 5 adjusts the valve timing of the intake valves by rotating the camshaft 202 relative to a crankshaft 201 of an internal combustion engine 200. The valve timing adjusting apparatus 5 is placed in a drive force transmission path for transmitting a drive force from the crankshaft 201 of the internal combustion engine 200 to the camshaft 202. The crankshaft 201 serves as a driving-side shaft of the present disclosure, and the camshaft 202 serves as a driven-side shaft.

First of all, an entire structure of the valve timing adjusting apparatus 5 will be described with reference to FIGS. 1 and 2.

Figure 2:
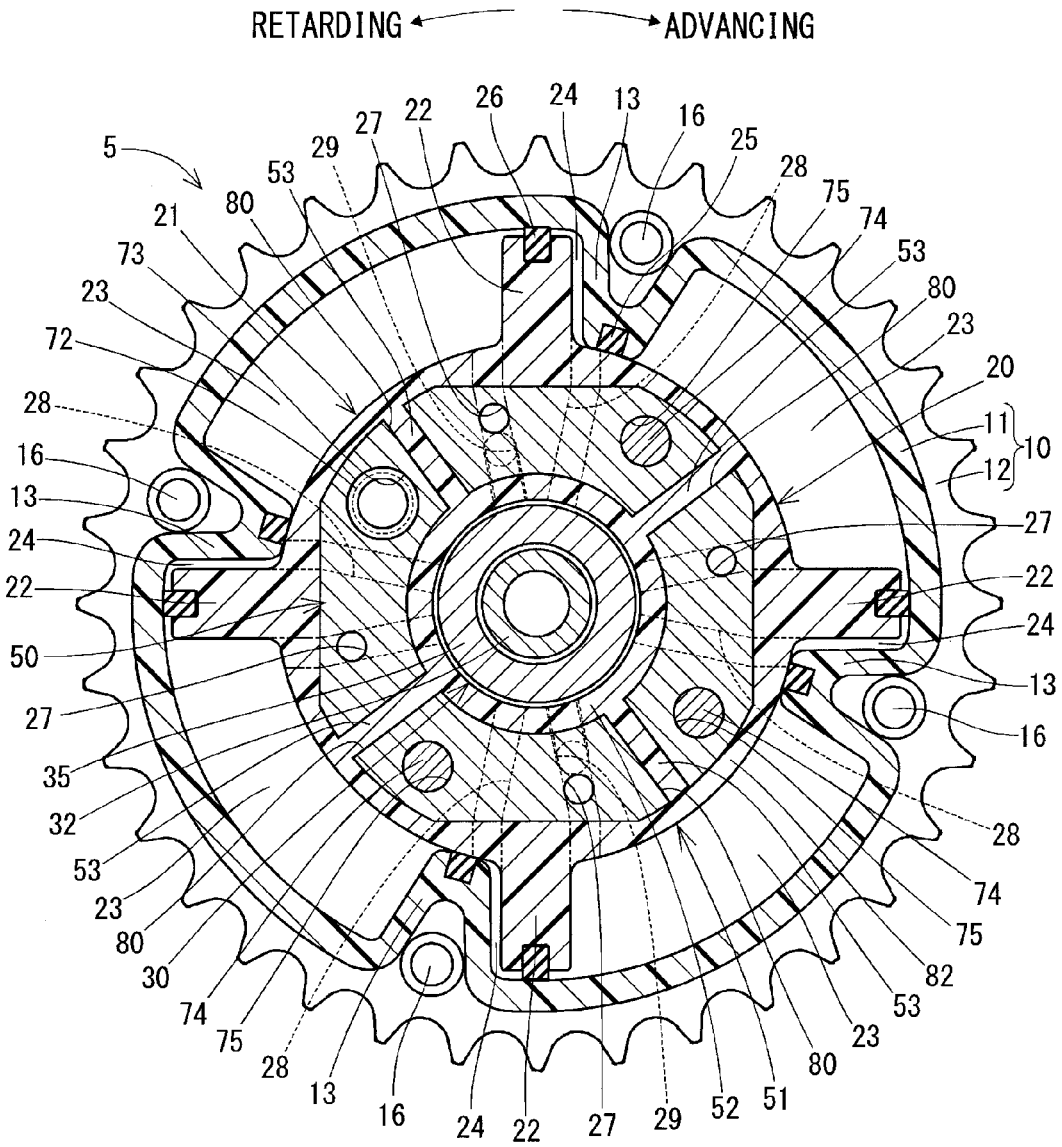
FIG. 2 is a cross-sectional view taken along line II-II in FIG. 1.

As shown in FIGS. 1 and 2, the valve timing adjusting apparatus 5 includes a housing 10, a vane rotor 20, and an oil pressure control valve 30.

The housing 10 includes a case 11 and a sprocket 12.

The case 11 is configured into a cup form and includes a plurality of projections 13, which radially inwardly project from an outer peripheral wall of the case 11. The projections 13 are arranged one after another at predetermined intervals in a circumferential direction.

The sprocket 12 is placed at an opening end of the case 11 and includes a through-hole 14, which receives the camshaft 202 therethrough. Furthermore, the sprocket 12 is connected to the crankshaft 201 through a timing chain 203, which are wound around external teeth 15 of the sprocket 12, so that the sprocket 12 is rotatable integrally with the crankshaft 201.

The case 11 and the sprocket 12 are arranged coaxially with the camshaft 202 and are fixed together at a plurality of locations, which are arranged one after another in the circumferential direction, with a plurality of bolts 16.

The vane rotor 20 is received in an inside of the housing 10, specifically an inside of the case 11. The vane rotor 20 includes a boss 21 and a plurality of vanes 22.

The boss 21 is fixed to the camshaft 202 with a sleeve bolt 31 described later, so that the boss 21 and the camshaft 202 are integrally rotatable.

The vanes 22 radially outwardly project from the boss 21. Each vane 22 partitions a corresponding part of an inner space of the housing 10. More specifically, each vane 22 partitions a corresponding inner space, which is defined between corresponding adjacent two of the projections 13 in the housing 10, into an advancing chamber 23 and a retarding chamber 24. The retarding chamber 24 is located on a side of the adjacent vane 22 in a rotational direction of the vane rotor 20, and the advancing chamber 23 is located on a side of the adjacent vane 22 in an opposite direction, which is opposite from the rotational direction of the vane rotor 20. Each radial gap, which is formed between the corresponding advancing chamber 23 and the corresponding retarding chamber 24, is sealed with a seal member 25, which is installed to a distal end of the corresponding projection 13 of the case 11, and a seal member 26, which is installed to a distal end of the corresponding vane 22.

The vane rotor 20 includes an advancing oil passage 27, a retarding oil passage 28, and a supply oil passage 29. The advancing oil passage 27 is communicated with the advancing chambers 23 and opens to an inner wall surface of the boss 21. The retarding oil passage 28 is communicated with the retarding chambers 24 and opens to the inner wall surface of the boss 21. The supply oil passage 29 is communicated with an oil pump 206, which is an external oil supply source, through a supply oil passage 204 of the camshaft 202 and a supply oil passage of, for example, an engine block.

The vane rotor 20 is rotatable relative to the housing 10 when a pressure force of working oil supplied to the advancing chambers 23 or the retarding chambers 24 is applied to the vane rotor 20 to change a rotational phase of the vane rotor 20 relative to the housing 10 to a advancing side or a retarding side.

The oil pressure control valve 30 includes a sleeve bolt 31 and a spool 32.

The sleeve bolt 31 is inserted into the vane rotor 20 from an opposite side, which is opposite from the camshaft 202, such that the sleeve bolt 31 is threaded into the camshaft 202. Furthermore, the sleeve bolt 31 forms a sleeve 35, which is placed on a radially inner side of the vane rotor 20, at a location between a head 33 and a threaded portion 34 of the sleeve bolt 31.

The sleeve 35 is configured into a tubular form and extends in an axial direction at a center portion of the vane rotor 20. Furthermore, the sleeve 35 includes an advancing port 36, which is communicated with the advancing oil passage 27, a retarding port 37, which is communicated with the retarding oil passage 28, and a supply port 38, which is communicated with the supply oil passage 29. In the present embodiment, the sleeve 35 includes a plurality of annular grooves 41, 42, 43, which are arranged one after another in the axial direction. The advancing port 36, the supply port 38, and the retarding port 37 open to bottom surfaces of the annular grooves 41, 42, 43.

The spool 32 is reciprocatable (i.e., displaceable) in the axial direction in an inside of the sleeve 35 to selectively communicate between corresponding ones of the ports 36, 37, 38 of the sleeve 35 depending on an axial position of the spool 32. Specifically, in a case where the rotational phase of the vane rotor 20 relative to the housing 10 is changed to the advancing side (i.e., when the vane rotor 20 is rotated to the advancing side relative to the housing 10), the spool 32 connects between the supply port 38 and the advancing port 36 and communicates the retarding port 37 to an external drain space located at an outside through the inside of the spool 32. Furthermore, in a case where the rotational phase of the vane rotor 20 relative to the housing 10 is changed to the retarding side (i.e., when the vane rotor 20 is rotated to the retarding side relative to the housing 10), the spool 32 connects between the supply port 38 and the retarding port 37 and communicates the advancing port 36 to the external drain space through an outside of the spool 32.

A stopper plate 44 is fitted to an opening of the sleeve bolt 31, which is located in an inside of the head 33 of the sleeve bolt 31. The spool 32 is urged to the stopper plate 44 by a spring 45. An axial position of the spool 32 is determined by a balance between an urging force of the spring 45 and an urging force of a linear solenoid 46, which is located on an opposite side of the stopper plate 44, which is opposite from the spool 32.

In the valve timing adjusting apparatus 5, which is constructed in the above-described manner, in the case where the rotational phase is on a retarding side of a target value, the oil pressure control valve 30 connects between the supply oil passage 29 and the advancing chambers 23 and communicates the retarding chambers 24 to the external drain space. In this way, the working oil is supplied to the advancing chambers 23, and the working oil is drained from the retarding chambers 24. Thereby, the vane rotor 20 is rotated relative to the housing 10 toward the advancing side.

Furthermore, in the case where the rotational phase is on the advancing side of the target value, the oil pressure control valve 30 connects between the supply oil passage 29 and the retarding chambers 24 and communicates the advancing chambers 23 to the external drain space. In this way, the working oil is supplied to the retarding chambers 24, and the working oil is drained from the advancing chambers 23. Thereby, the vane rotor 20 is rotated relative to the housing 10 toward the retarding side.

Furthermore, in a case where the rotational phase coincides with the target value, the oil pressure control valve 30 closes the advancing chambers 23 and the retarding chambers 24. In this way, the current rotational phase is maintained.

Next, the characteristic structure of the valve timing adjusting apparatus 5 will be described.

Figure 3:
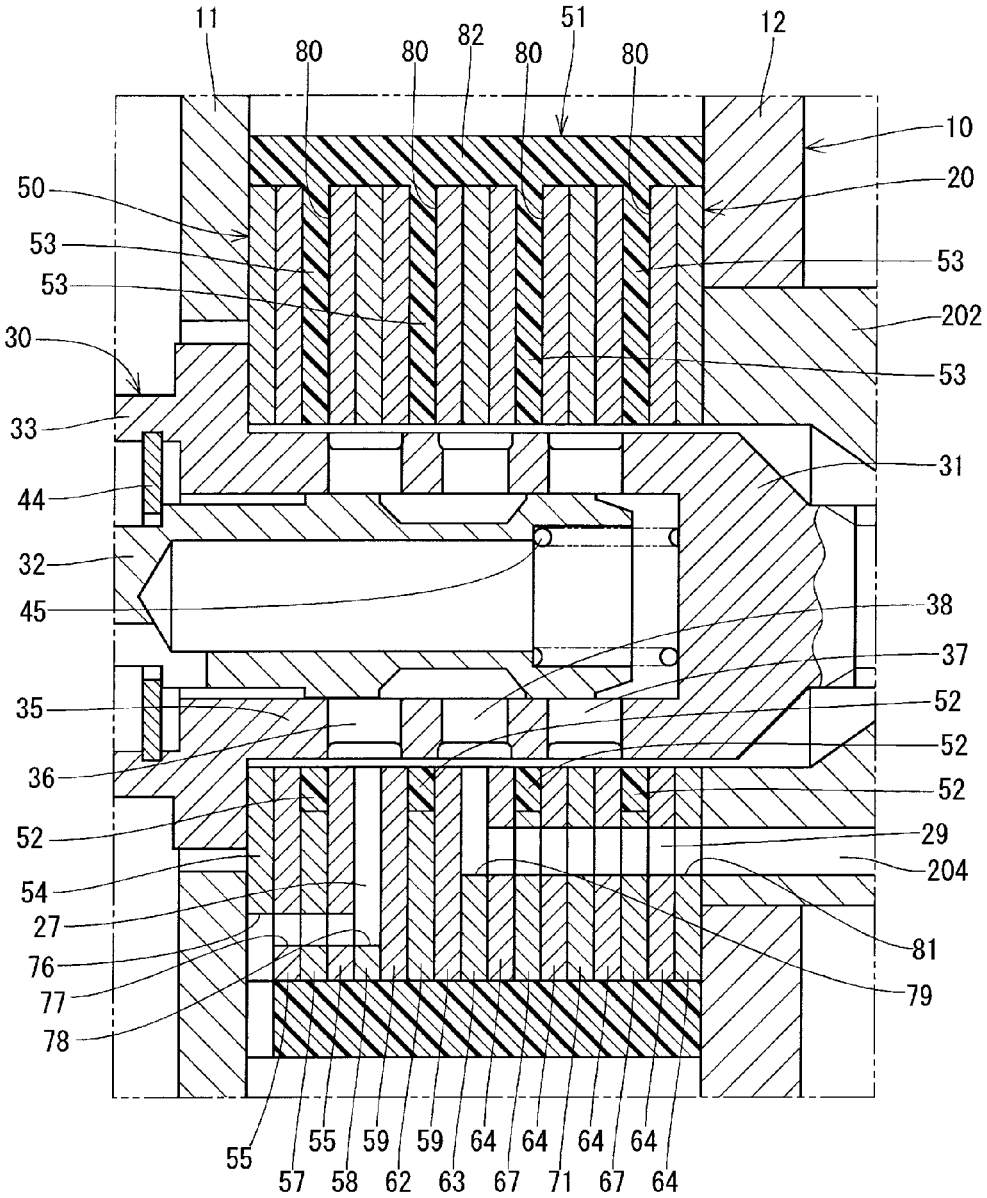
FIG. 3 is an enlarged partial view showing an area III in FIG. 1.

As shown in FIGS. 2 and 3, the vane rotor 20 includes a laminated portion 50, a molding portion 51, a plurality of seal portions (four seal portions in this embodiment) 52, and a plurality of connecting portions (four connecting portions in this embodiment) 53.

As shown in FIG. 3, the laminated portion 50 is configured into a tubular form and includes a plurality of metal plates, which are stacked one after another in the axial direction. Specifically, the laminated portion 50 includes a metal plate 54 shown in FIG. 4, a metal plate 55 shown in FIG. 5, metal plates 56, 57 (more specifically, a set of metal plates 56, 57 placed along a common plane) shown in FIG. 6, a metal plate 55, a metal plate 58 shown in FIG. 7, a metal plate 59 shown in FIG. 8, metal plates 61, 62 (more specifically, a set of metal plates 61, 62 placed along a common plane) shown in FIG. 9, a metal plate 59, a metal plate 63 shown in FIG. 10, a metal plate 64 shown in FIG. 11, metal plates 65, 66, 67 (more specifically, a set of metal plates 65, 66, 67 placed along a common plane) shown in FIG. 12, a metal plate 64, metal plates 68, 69, 71 (more specifically, a set of metal plates 68, 69, 71 placed along a common plane) shown in FIG. 13, a metal plate 64, metal plates 65, 66, 67 (more specifically, another set of metal plates 65, 66, 67 placed along a common plane) and two metal plates 64, which are stacked in this order in the axial direction.

In the following discussion, unless otherwise noted, the metal plates 54-59, 61-69, 71 will be simply referred to as metal plates.

In the present embodiment, each axially adjacent two of the metal plates are assembled together by fitting recesses (not shown), which are formed in one of the axially adjacent two metal plates, into protrusions (not shown), which are formed in the other one of the axially adjacent two metal plates.

As shown in FIG. 2, the laminated portion 50 includes a receiving hole 73, which receives a lock pin 72, and three press fitting holes 75, into which limiting pins 74 are respectively press fitted. The lock pin 72 is provided to lock the rotational phase of the vane rotor 20 relative to the housing 10. When the lock pin 72 is fitted into a fitting hole (not shown) of the sprocket 12, the rotational phase of the vane rotor 20 relative to the housing 10 is locked. The limiting pins 74 are provided to limit a change in the rotational phase of the vane rotor 20 relative to the housing 10 within a predetermined range. One end part of each limiting pin 74 is inserted into a corresponding elongated hole of the case 11, which is elongated into an arcuate form in the circumferential direction, and the other end part of the limiting pin 74 is inserted into a corresponding elongated hole of the sprocket 12, which is elongated into an arcuate form in the circumferential direction. Thereby, the change in the rotational phase of the vane rotor 20 relative to the housing 10 is limited within a corresponding circumferential range that is from one circumferential end position, at which the limiting pin 74 contacts one circumferential ends of the corresponding elongated holes of the case 11 and the sprocket 12, to other circumferential end position, at which the limiting pin 74 contacts the other circumferential ends of the corresponding elongated holes of the case 11 and the sprocket 12.

Figure 4:
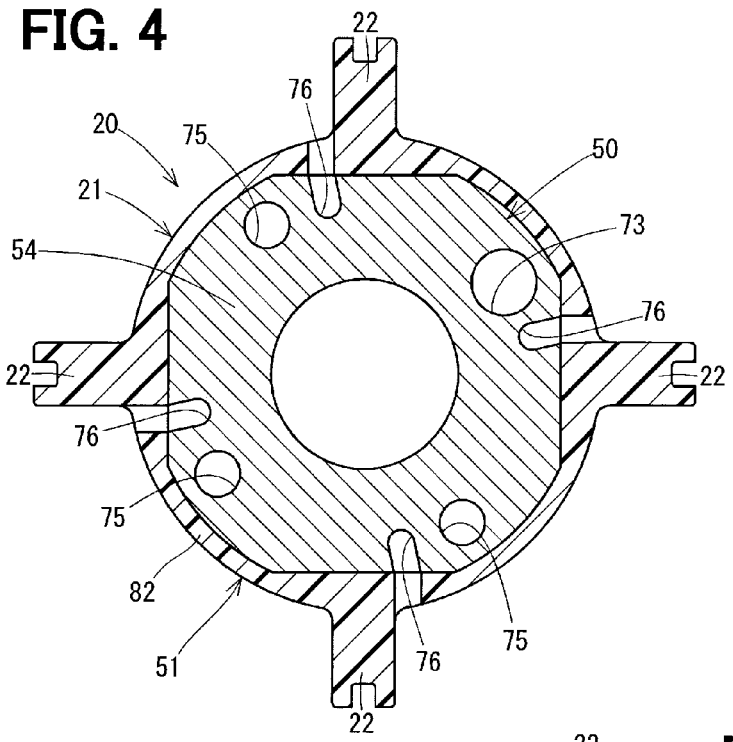
FIG. 4 is a cross-sectional view of a vane rotor of FIG. 1, which is taken at an axial position that coincides with a first metal plate of a laminated portion.

As shown in FIG. 4, the metal plate 54 includes a receiving hole 73, three press fitting holes 75 and four primary advancing side notches (recesses) 76. Each primary advancing side notch 76 radially inwardly extends from an outer peripheral edge of the metal plate 54 and forms a portion of the advancing oil passage 27.

Figure 5:
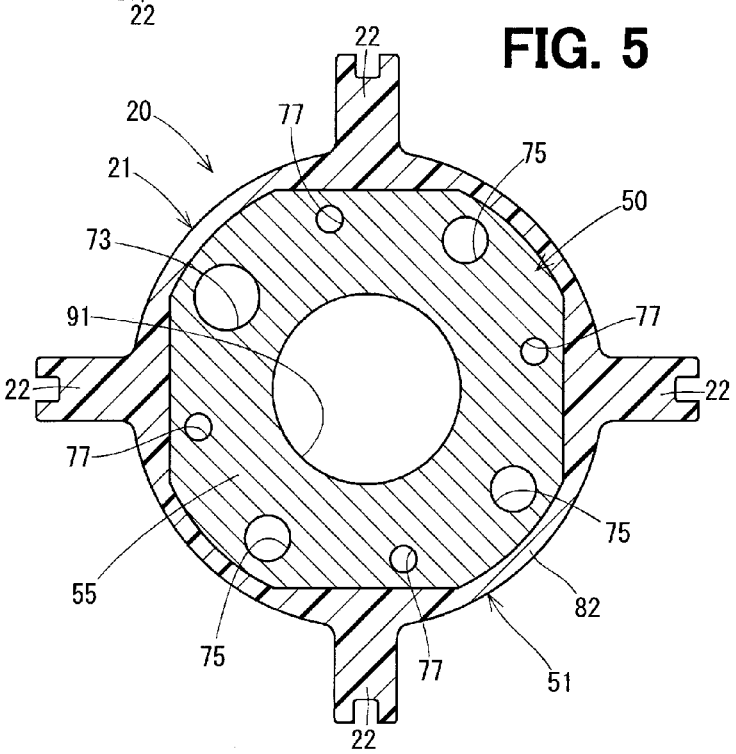
FIG. 5 is a cross-sectional view of the vane rotor of FIG. 1, which is taken at an axial position that coincides with a second metal plate of the laminated portion.

As shown in FIG. 5, the metal plate 55 includes a receiving hole 73, three press fitting holes 75, and four advancing side through-holes 77. Each advancing side through-hole 77 extends through the metal plate 55 in a plate thickness direction (i.e., a direction perpendicular to a plane of the metal plate) and forms a portion of the advancing oil passage 27. Each advancing side through-hole 77 is formed in a corresponding location, which coincides with a radially inner end part of the corresponding primary advancing side notch 76 in a view taken in the axial direction.

Figure 6:
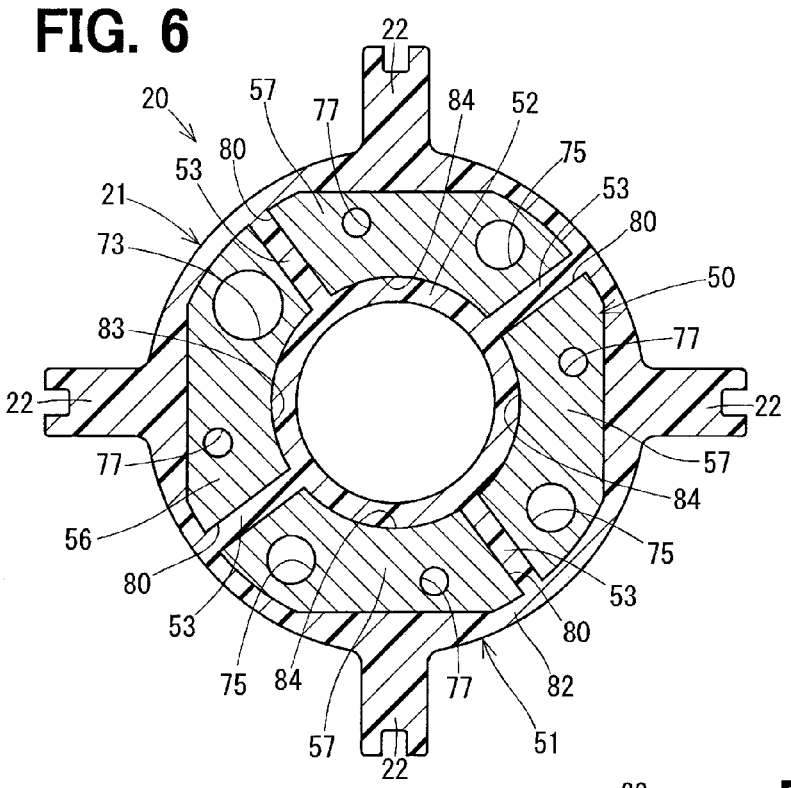
FIG. 6 is a cross-sectional view of the vane rotor of FIG. 1, which is taken at an axial position that coincides with a third metal plate of the laminated portion.

As shown in FIG. 6, the metal plate 56 and the three metal plates 57 are placed one after another in the circumferential direction while a circumferential interval is provided between each circumferentially adjacent two of the metal plates 56, 57. An inner peripheral edge 83 of the metal plate 56 and inner peripheral edges 84 of the metal plates 57 are located on a radially outer side of inner peripheral edges 91 of the metal plates 55, which are located on two opposite axial sides, respectively, of the metal plates 56, 57. The metal plate 56 includes a receiving hole 73 and an advancing side through-hole 77. Each of the metal plates 57 includes a press fitting hole 75 and an advancing side through-hole 77.

Figure 7:
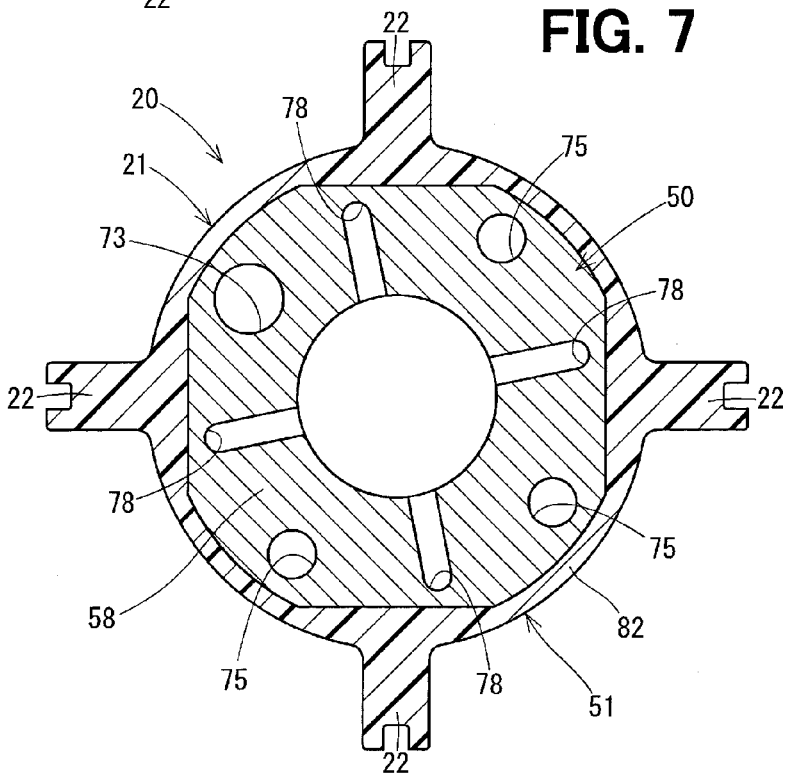
FIG. 7 is a cross-sectional view of the vane rotor of FIG. 1, which is taken at an axial position that coincides with a fourth metal plate of the laminated portion.

As shown in FIG. 7, the metal plate 58 includes a receiving hole 73, three press fitting holes 75 and four secondary advancing side notches (recesses) 78. Each secondary advancing side notch 78 radially outwardly extends from an inner peripheral edge of the metal plate 58 and forms a portion of the advancing oil passage 27. A radially outer end part of each secondary advancing side notch 78 is formed in a corresponding location, which coincides with the corresponding advancing side through-hole 77 in the view taken in the axial direction.

Figure 8:
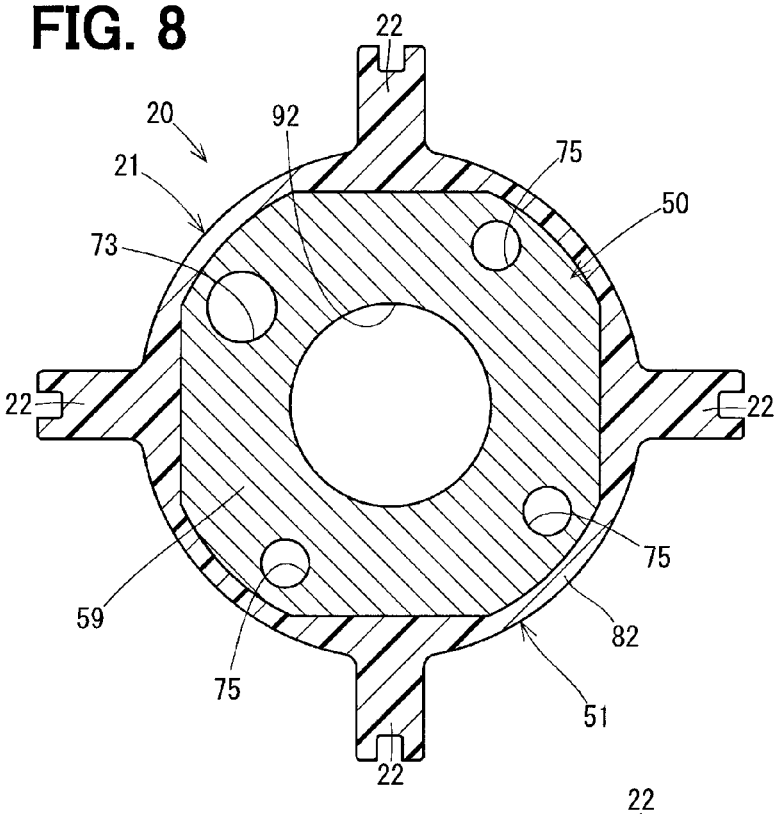
FIG. 8 is a cross-sectional view of the vane rotor of FIG. 1, which is taken at an axial position that coincides with a fifth metal plate of the laminated portion.

As shown in FIG. 8, the metal plate 59 includes a receiving hole 73 and three press fitting holes 75.

Figure 9:
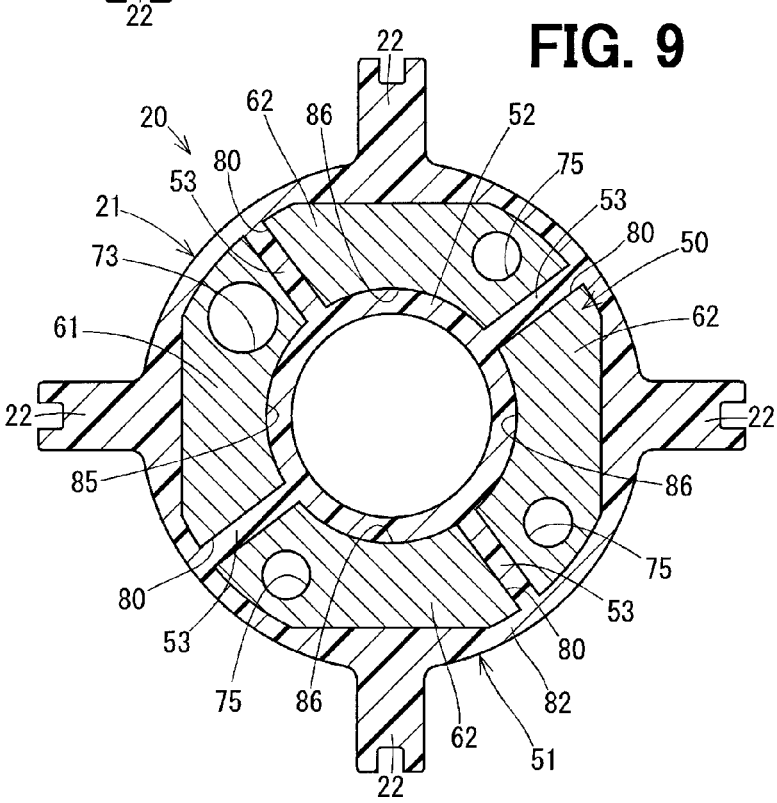
FIG. 9 is a cross-sectional view of the vane rotor of FIG. 1, which is taken at an axial position that coincides with a sixth metal plate of the laminated portion.

As shown in FIG. 9, the metal plate 61 and the three metal plates 62 are placed one after another in the circumferential direction while a circumferential interval is provided between each circumferentially adjacent two of the metal plates 61, 62. An inner peripheral edge 85 of the metal plate 61 and inner peripheral edges 86 of the metal plates 62 are located on a radially outer side of the inner peripheral edge 91 of the metal plate 55 and the inner peripheral edge 92 of the metal plate 59, which are located on two opposite axial sides, respectively, of the metal plates 61, 62. The metal plate 61 includes a receiving hole 73. Each of the metal plates 62 includes a press fitting hole 75.

Figure 10:
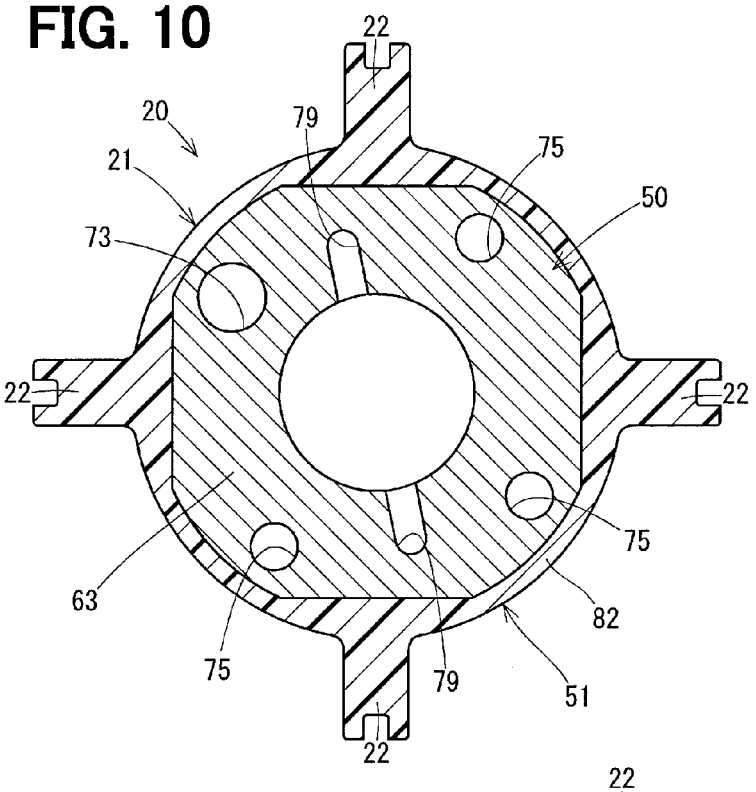
FIG. 10 is a cross-sectional view of the vane rotor of FIG. 1, which is taken at an axial position that coincides with a seventh metal plate of the laminated portion.

As shown in FIG. 10, the metal plate 63 includes a receiving hole 73, three press fitting holes 75 and two supply notches (recesses) 79. Each supply notch 79 radially outwardly extends from an inner peripheral edge of the metal plate 63 and forms a portion of the supply oil passage 29.

Figure 11:
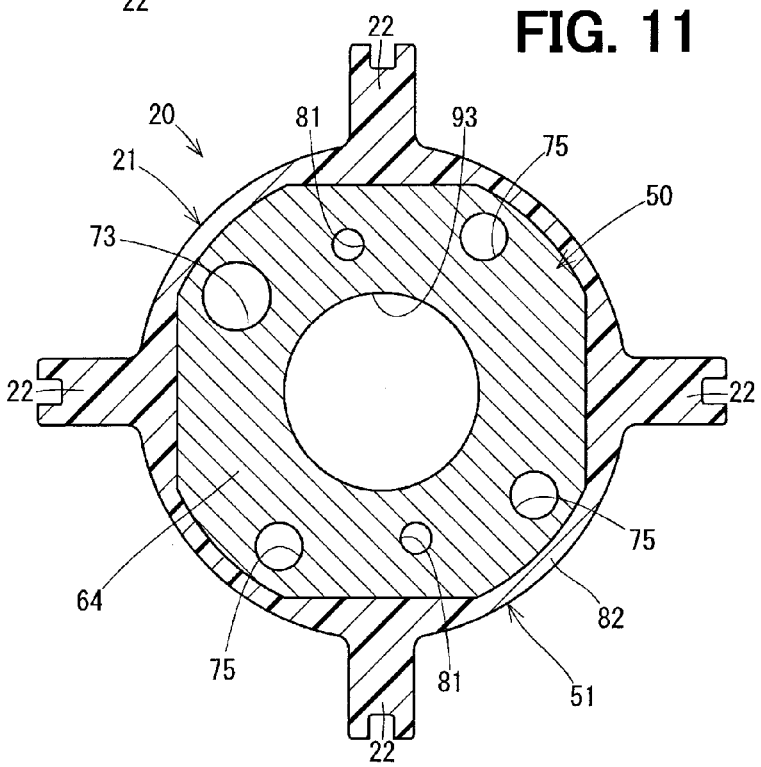
FIG. 11 is a cross-sectional view of the vane rotor of FIG. 1, which is taken at an axial position that coincides with an eighth metal plate of the laminated portion.

As shown in FIG. 11, the metal plate 64 includes a receiving hole 73, three press fitting holes 75, and two supply through-holes 81. Each supply through-hole 81 extends through the metal plate 64 in a plate thickness direction (i.e., a direction perpendicular to a plane of the metal plate) and forms a portion of the supply oil passage 29. Each supply through-hole 81 is formed at a corresponding location, which coincides with a radially outer end part of the corresponding supply notch 79 in the view taken in the axial direction.

Figure 12:
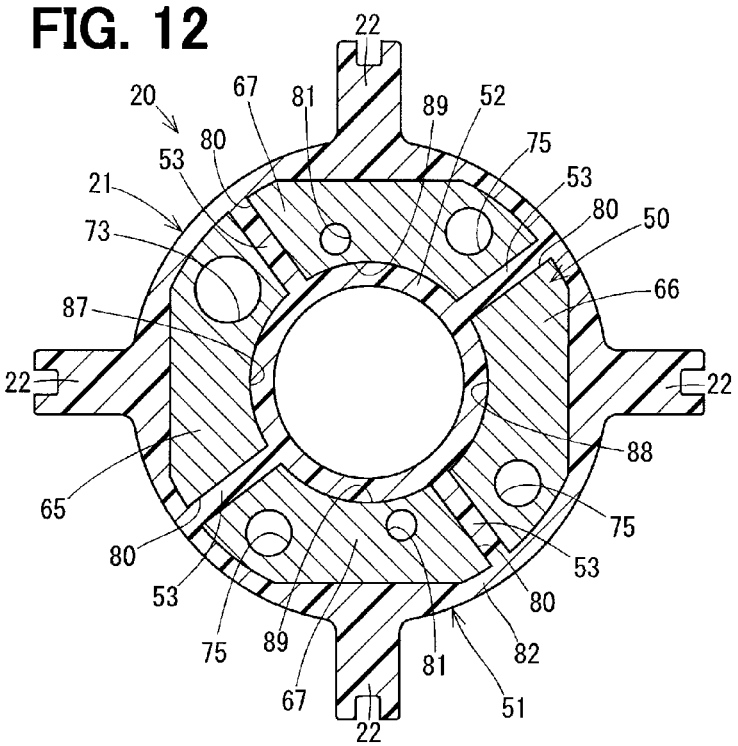
FIG. 12 is a cross-sectional view of the vane rotor of FIG. 1, which is taken at an axial position that coincides with a ninth metal plate of the laminated portion.

As shown in FIG. 12, the metal plate 65, the metal plate 66 and the two metal plates 67 are placed one after another in the circumferential direction while a circumferential interval is provided between each circumferentially adjacent two of the metal plates 65, 66, 67. An inner peripheral edge 87 of the metal plate 65, an inner peripheral edge 88 of the metal plate 66, and inner peripheral edges 89 of the metal plates 67 are placed on a radially outer side of inner peripheral edges 93 of the metal plates 64, which are located on two opposite axial sides, respectively, of the metal plates 65, 66, 67. The metal plate 65 includes a receiving hole 73. The metal plate 66 includes a press fitting hole 75. Each of the metal plates 67 includes a press fitting hole 75 and a supply through-hole 81.

Figure 13:
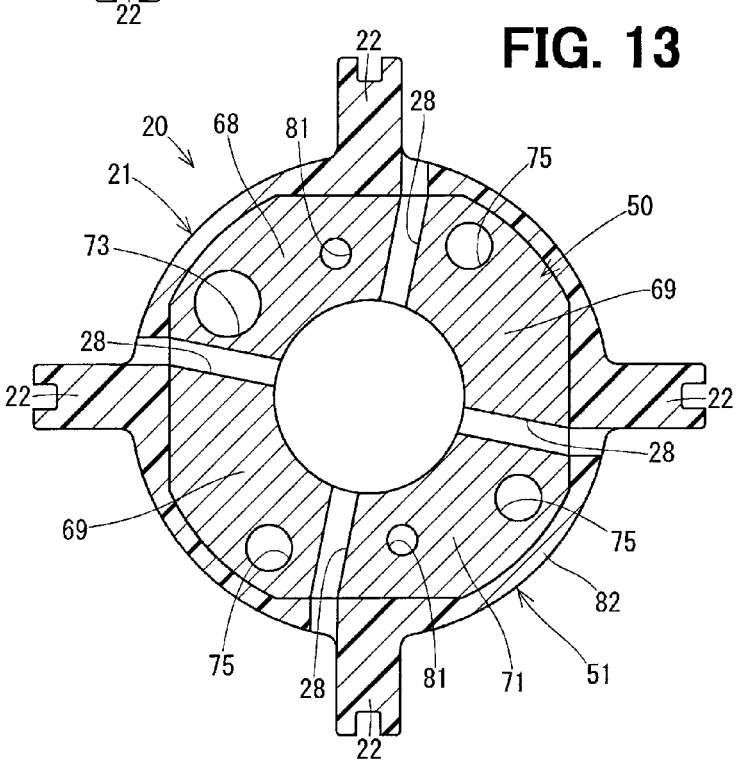
FIG. 13 is a cross-sectional view of the vane rotor of FIG. 1, which is taken at an axial position that coincides with a tenth metal plate of the laminated portion.

As shown in FIG. 13, the metal plate 68, the two metal plates 69 and the metal plate 71 are placed one after another in the circumferential direction while a circumferential interval is provided between each circumferentially adjacent two of the metal plates 68, 69, 71. The metal plate 68 includes a receiving hole 73 and a supply through-hole 81. Each of the metal plates 69 includes a press fitting hole 75. The metal plate 71 includes a press fitting hole 75 and a supply through-hole 81.

As shown in FIGS. 2 and 3, the molding portion 51 includes a tubular portion 82 and four vanes 22. The tubular portion 82 surrounds an outer peripheral wall surface of the laminated portion 50.

Each of the seal portions 52 is configured into an annular form to extend in the circumferential direction along an outer peripheral surface of the sleeve 35. Corresponding two of the seal portions 52 are placed at two axial sides, respectively, of each of the advancing port 36, the retarding port 37, and the supply port 38 of the sleeve 35. Each of the seal portions 52 contacts (or is engaged with) an inner peripheral wall surface of the laminated portion 50 except at least a circumferential part of the seal portion 52, more specifically, a circumferential part of the seal portion 52, which is connected to a corresponding one of the connecting portions 53, so that deformation (as well as displacement) of the seal portion 52 toward a radially outer side is limited. Specifically, the four seal portions 52 include first to fourth seal portions 52, which are arranged one after another in this order in the axial direction from the head 33 side. Thereby, as shown in FIG. 6, the first seal portion 52 contacts the inner peripheral edge 83 of the metal plate 56 and the inner peripheral edges 84 of the metal plates 57. As shown in FIG. 9, the second seal portion 52 contacts the inner peripheral edge 85 of the metal plate 61 and the inner peripheral edges 86 of the metal plates 62. Furthermore, as shown in FIG. 12, the third seal portion 52 contacts the inner peripheral edge 87 of the metal plate 65, the inner peripheral edge 88 of the metal plate 66, and the inner peripheral edges 89 of the metal plates 67 (i.e., the inner peripheral edges 87, 88, 89 of the one set of the metal plates 65, 66, 67). Similar to the third seal portion 52, the fourth seal portion 52 contacts the inner peripheral edge 87 of the metal plate 65, the inner peripheral edge 88 of the metal plate 66, and the inner peripheral edges 89 of the metal plates 67 (i.e., the inner peripheral edges 87, 88, 89 of the other set of the metal plates 65, 66, 67).

As shown in FIGS. 2 and 3, the laminated portion 50 includes a plurality of through-holes 80, each of which extends from the outer peripheral wall surface of the laminated portion 50 to the corresponding seal portion 52. In the present embodiment, corresponding two of the through-holes 80 are placed on two circumferential sides of each of the metal plates 56, 57, and corresponding two of the through-holes 80 are placed on two circumferential sides of each of the metal plates 61, 62. Furthermore, corresponding two of the through-holes 80 are placed on two circumferential sides of each of the metal plates 65, 66, 67. That is, the multiple through-holes 80 are provided such that each through-hole 80 radially outwardly projects from the corresponding seal portion 52. As shown in FIGS. 6, 9, and 12, corresponding four of the through-holes 80, which are placed at the same axial position (common axial position), i.e., the same plane (common plane), are arranged one after another at equal intervals in the circumferential direction. Furthermore, the number of the through-holes 80 located at the same axial position (common axial position) is equal to the number (four in this embodiment) of the vanes 22. Each of the vanes 22 is interposed between corresponding circumferentially adjacent two of the through-holes 80, which are placed in the same axial position (common axial position).

As shown in FIGS. 3, 6, 9, and 12, each of the connecting portions 53 is formed to extend from the tubular portion 82 of the molding portion 51 to the corresponding seal portion 52 through the corresponding through-hole 80.

The molding portion 51, the seal portions 52 and the connecting portions 53 are integrally formed as a common member (single member) and are made of a material, which has a thermal expansion coefficient that is larger than a thermal expansion coefficient of the material of each of the metal plates. In the present embodiment, the molding portion 51, the seal portions 52 and the connecting portions 53 are made of resin and are molded through a process of filling molten resin into a metal mold, in which the laminated portion 50 is set, and a process of solidifying the molten resin filled in the metal mold.

As discussed above, in the first embodiment, the vane rotor 20 includes the laminated portion 50 and the seal portions 52. The laminated portion 50 includes the multiple metal plates, which are stacked one after another in the axial direction. Each of the seal portions 52 is configured into the annular form to extend in the circumferential direction along the outer peripheral surface of the sleeve 35, and the corresponding two of the seal portions 52 are placed on two axial sides, respectively, of each of the advancing port 36, the retarding port 37, and the supply port 38 of the sleeve 35. Furthermore, each of the seal portions 52 contacts the inner peripheral wall surface (the inner peripheral edges 83-89) of the laminated portion 50 except at least the circumferential part of the seal portion 52 to limit radially outward deformation of the seal portion 52, and each seal portion 52 is made of the resin, which has the thermal expansion coefficient that is larger than the thermal expansion coefficient of each metal plate.

With the above structure, when each corresponding portion of the valve timing adjusting apparatus 5 undergoes the thermal expansion during the operational process that causes the high temperature of the corresponding portion of the valve timing adjusting apparatus 5, each seal portion 52 of the vane rotor 20 is deformed toward the radially inner side in the greater amount because the deformation of the seal portion 52 toward the radially outer side is limited by the laminated portion 50. Thereby, the clearance between the seal portion 52 of the vane rotor 20 and the sleeve 35 is reduced, and thereby the sealing between the ports of the sleeve 35 is improved. Therefore, the deterioration of the operational speed of the vane rotor 20 can be limited, and the deterioration of the holdability of the rotational phase of the vane rotor 20 relative to the housing 10 can be limited.

Furthermore, in the vane rotor 20, the inner peripheral wall surface of the laminated portion 50, i.e., the inner peripheral edge of each metal plate of the laminated portion 50 does not have the sealing function for sealing between the ports of the sleeve 35. Therefore, even when a tolerance of the inner diameter of the respective metal plates is set to be relatively large, the sealing performance for sealing between the ports is not deteriorated. As a result, the required sealing performance for sealing between the ports can be achieved even when the dimensional tolerance of the inner peripheral edges of the metal plates is reduced. Thereby, the manufacturing costs of the metal plates can be reduced.

Furthermore, even in a case where a relatively wide range of tolerance is set for the outer diameter of the sleeve 35 to cause an increase in the clearance between the vane rotor 20 and the sleeve 35, the clearance can be reduced through the thermal expansion of the seal portions 52 of the vane rotor 20 in the high temperature state. Thus, even when the dimensional accuracy of the outer peripheral surface of the sleeve 35 is reduced, the required sealing performance for sealing between the ports of the sleeve 35 can be achieved. As a result, the manufacturing costs of the sleeve 35 can be reduced.

Furthermore, in the first embodiment, the laminated portion 50 of the vane rotor 20 includes the through-holes 80, each of which extends from the outer peripheral surface of the laminated portion 50 to the corresponding one of the seal portions 52. Furthermore, the vane rotor 20 includes the molding portion 51, which is molded to surround the outer peripheral wall surface of the laminated portion 50, and the connecting portions 53, each of which extends from the molding portion 51 to the corresponding one of the seal portions 52 through the corresponding through-hole 80. Therefore, the molding portion 51 and the seal portions 52 can be molded simultaneously, and thereby the productivity can be improved.

Furthermore, in the first embodiment, the multiple through-holes 80 are provided to each seal portion 52 to radially project from the seal portion 52. The corresponding one of the metal plates 56-57, 61-62, and 65-67 is interposed between each circumferentially adjacent two of the through-holes 80, which are located in the same axial position (common axial position). Thereby, the axial force of the sleeve bolt 31, which is the fastening member for fastening the vane rotor 20 to the camshaft 202, can be received at multiple circumferential locations, which are located at generally equal intervals in the circumferential direction, in the laminated portion 50 of the vane rotor 20.

Furthermore, in the first embodiment, each of the vanes 22 of the vane rotor 20 is interposed between corresponding circumferentially adjacent two of the through-holes 80, which are placed in the same axial position (common axial position). Therefore, at the time of molding the molding portion 51, the connecting portions 53 and the seal portions 52, it is possible to achieve the good flow of the molten resin in the metal mold. Thereby, it is possible to limit the generation of a void or a weld line in the molding portion 51, the connecting portions 53 and the seal portions 52.

Furthermore, in the first embodiment, the number of the through-holes 80 located at the same axial position (common axial position) is equal to the number (four in this embodiment) of the vanes 22. Therefore, at the time of molding the molding portion 51, the connecting portions 53 and the seal portions 52, it is possible to limit occurrence of uneven flow of the molten resin in the molding die. Thereby, it is possible to limit the generation of the void or the weld line in the molding portion 51, the connecting portions 53 and the seal portions 52.

Second Embodiment

A valve timing adjusting apparatus according to a second embodiment of the present disclosure will be described with reference to FIGS. 4-5, 7-8, 10-11, and 14-24.

Figure 14:
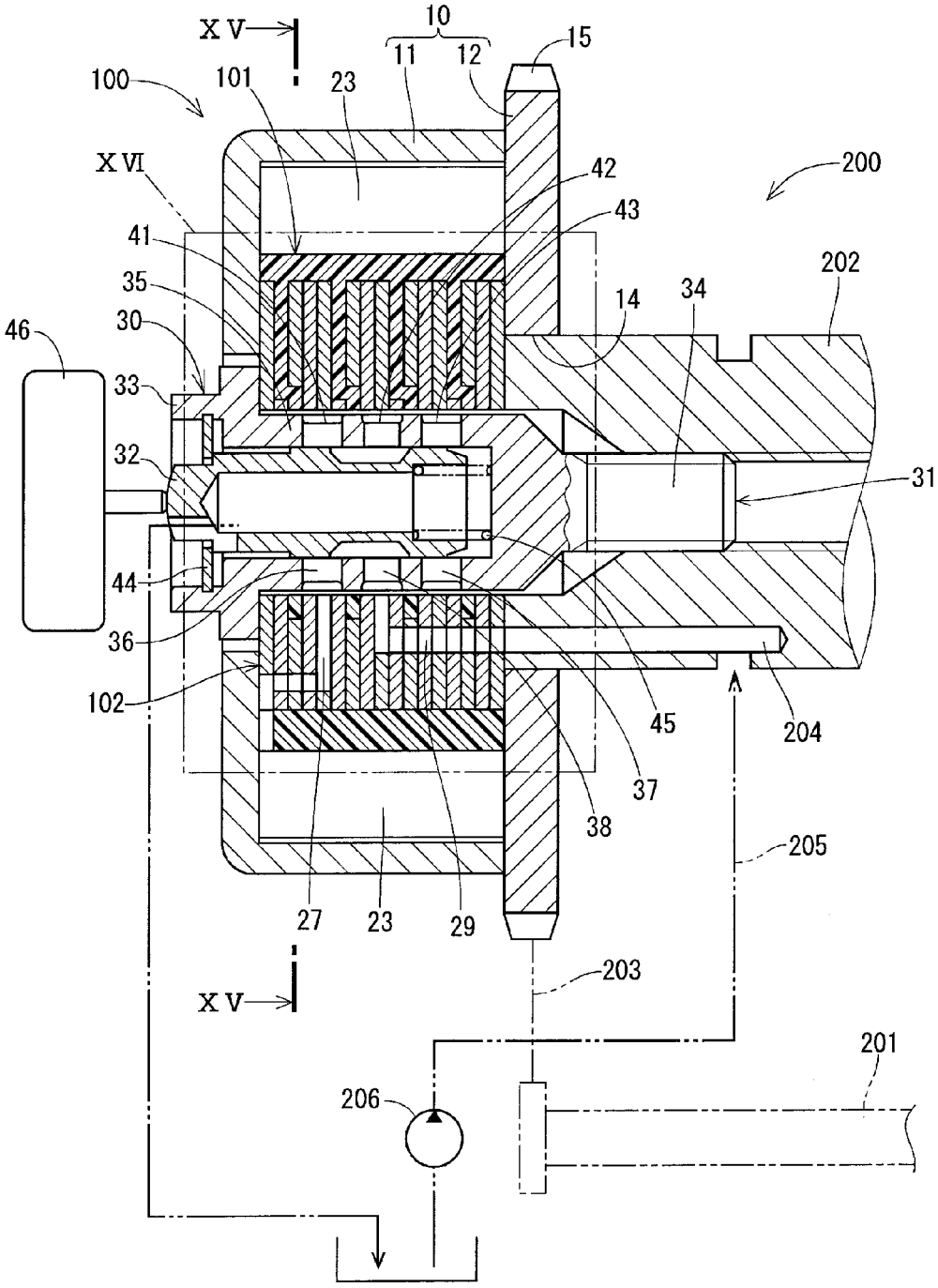
FIG. 14 is a cross-sectional view showing a schematic structure of a valve timing adjusting apparatus according to a second embodiment of the present disclosure.
Figure 15:
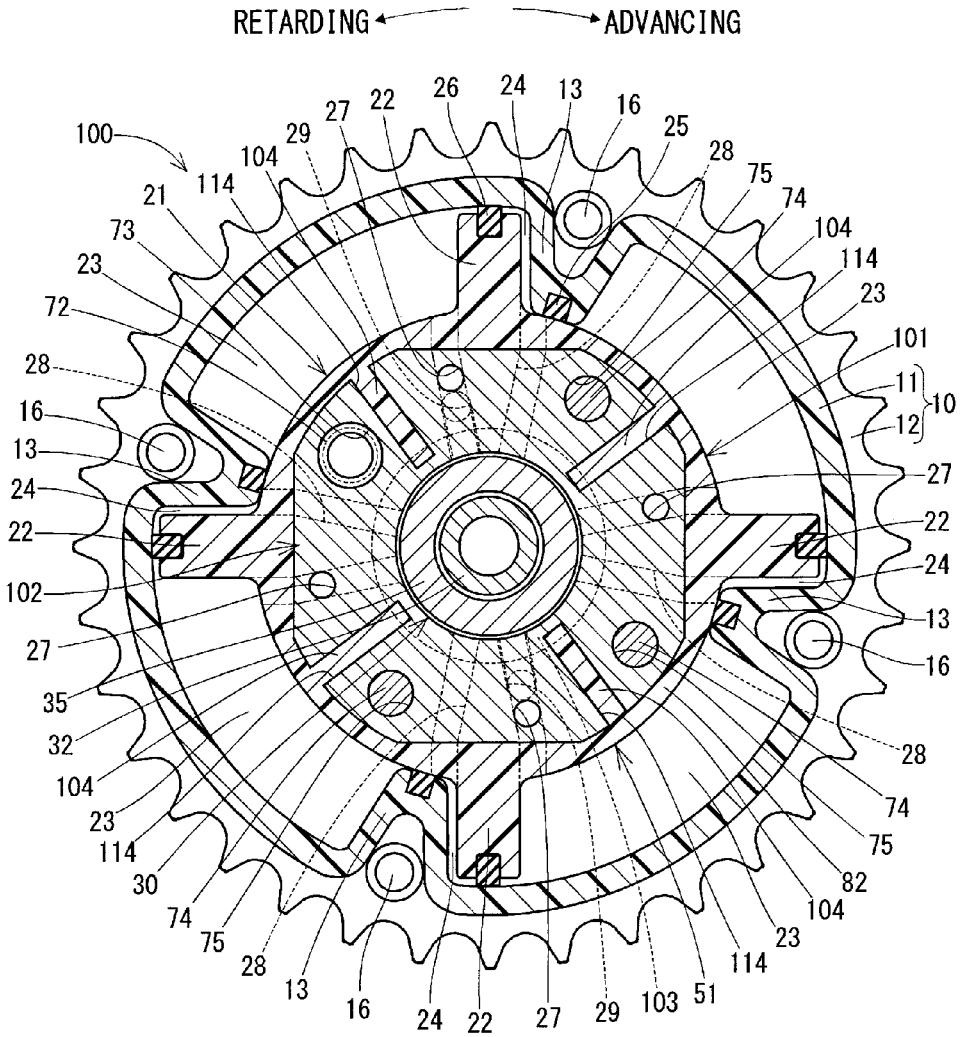
FIG. 15 is a cross sectional view taken along line XV-XV in FIG. 14.
Figure 16:
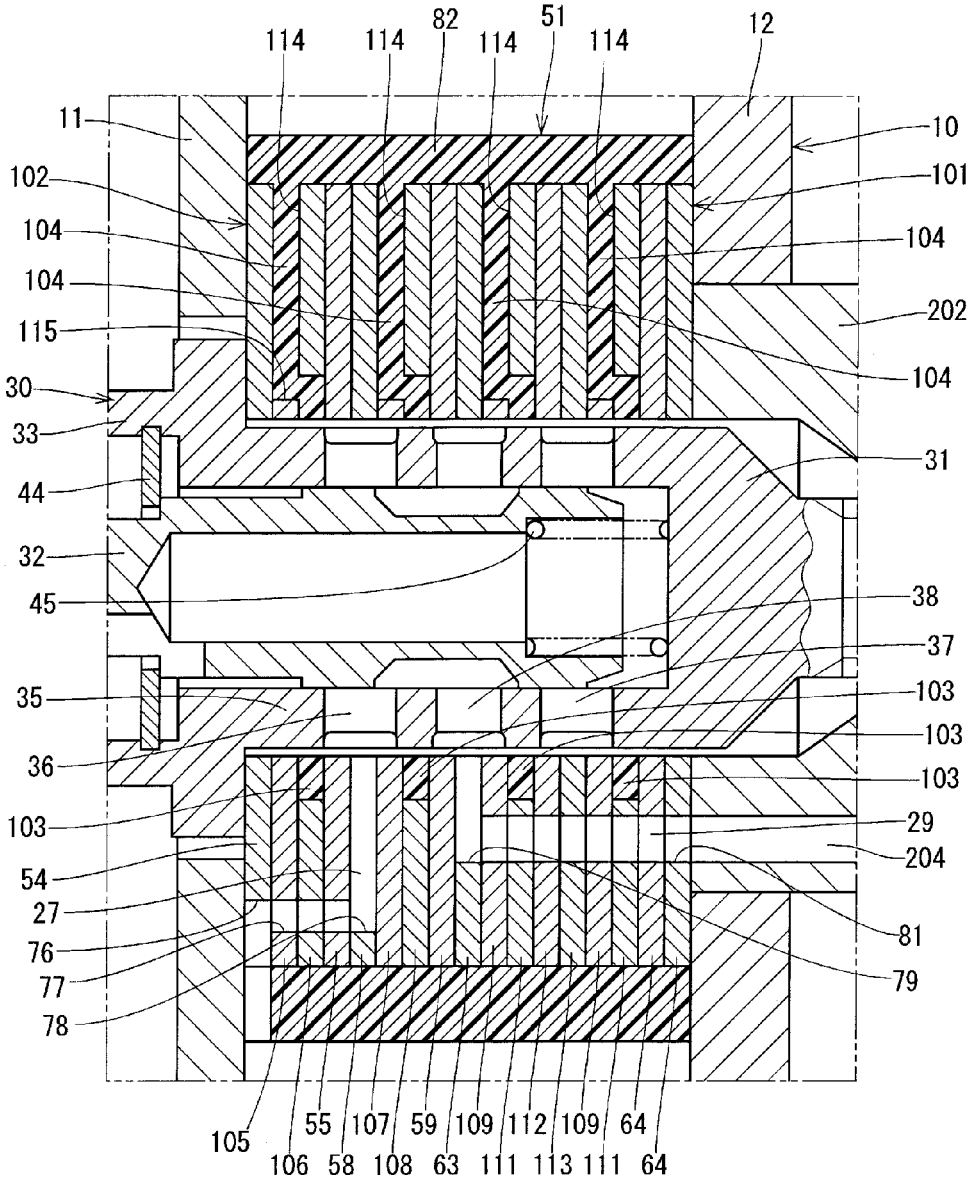
FIG. 16 is a partial enlarged view of a portion XVI in FIG. 14.

As shown in FIGS. 14 to 16, in the valve timing adjusting apparatus 100 of the present embodiment, the vane rotor 101 includes the laminated portion 102, the molding portion 51, the seal portions 103, and the connecting portions 104.

Figure 17:
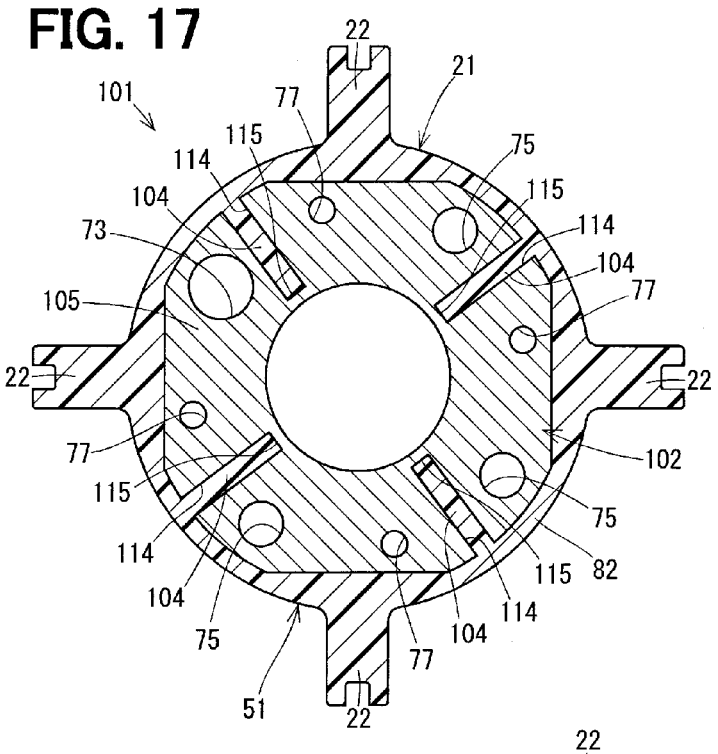
FIG. 17 is a cross-sectional view of a vane rotor of FIG. 14, which is taken at an axial position that coincides with an eleventh metal plate of the laminated portion.
Figure 18:
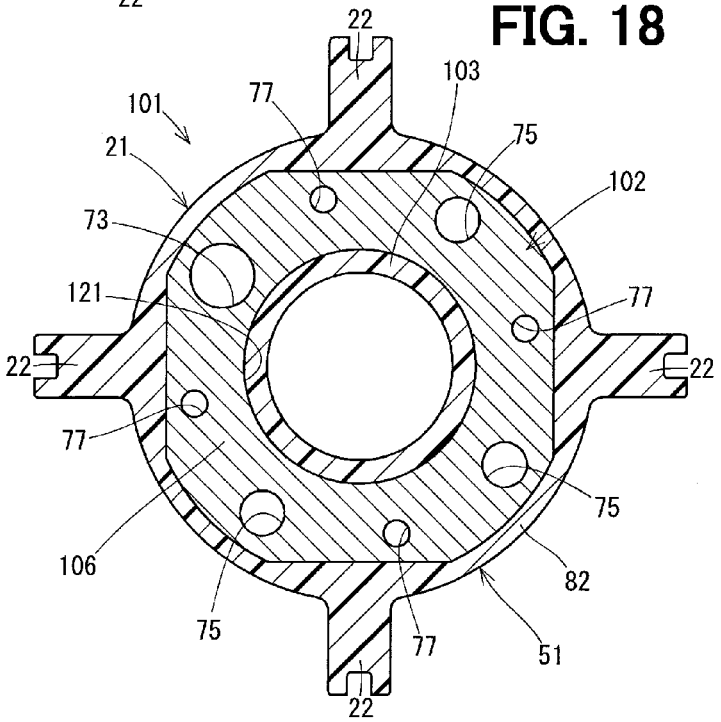
FIG. 18 is a cross-sectional view of the vane rotor of FIG. 14, which is taken at an axial position that coincides with a twelfth metal plate of the laminated portion.
Figure 19:
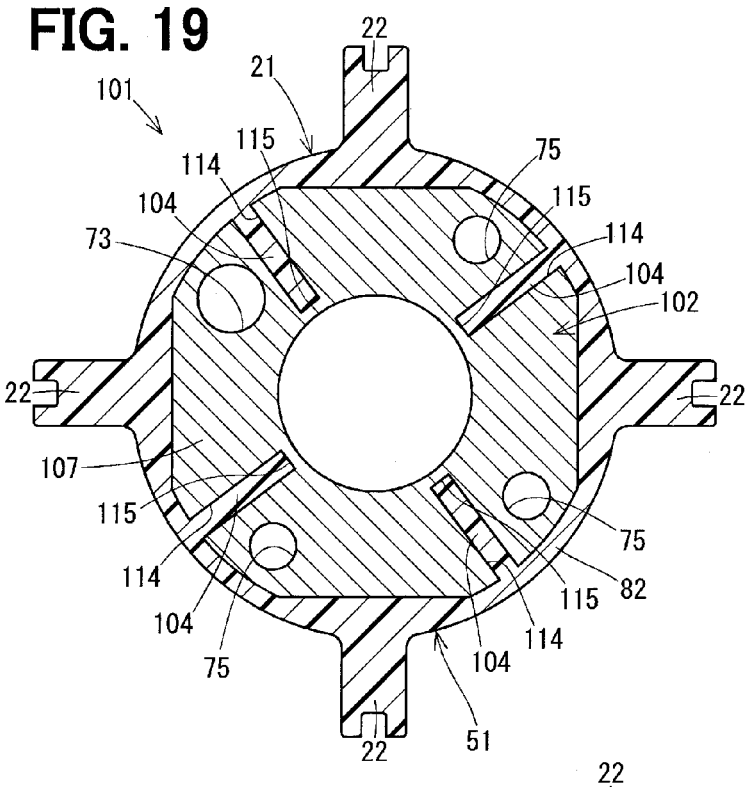
FIG. 19 is a cross-sectional view of the vane rotor of FIG. 14, which is taken at an axial position that coincides with a thirteenth metal plate of the laminated portion.

As shown in FIG. 16, the laminated portion 102 includes a metal plate 54 shown in FIG. 4, a metal plate 105 shown in FIG. 17, a metal plate 106 shown in FIG. 18, a metal plate 55 shown in FIG. 5, a metal plate 58 shown in FIG. 7, a metal plate 107 shown in FIG. 19, a metal plate 108 shown in FIG.

Figure 21:
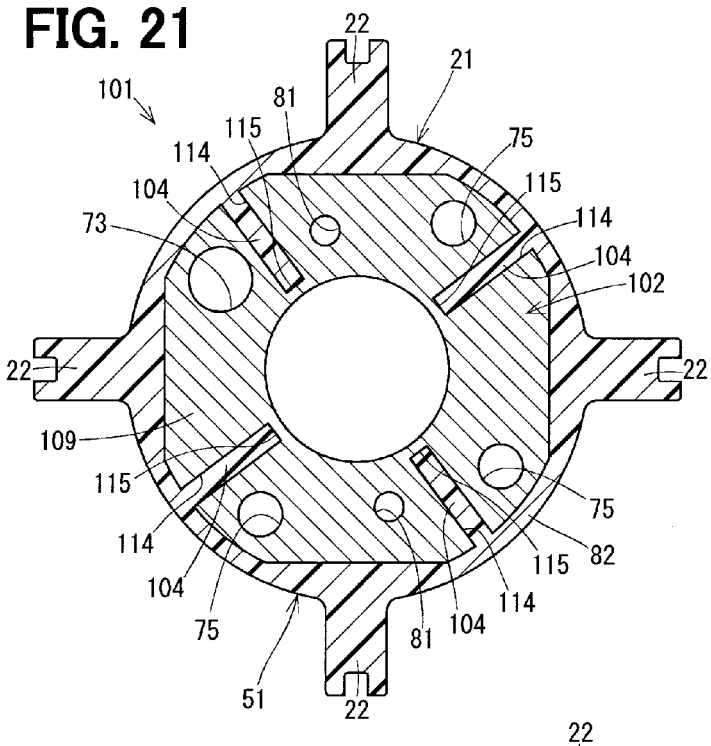
FIG. 21 is a cross-sectional view of the vane rotor of FIG. 14, which is taken at an axial position that coincides with a fifteenth metal plate of the laminated portion.
Figure 22:
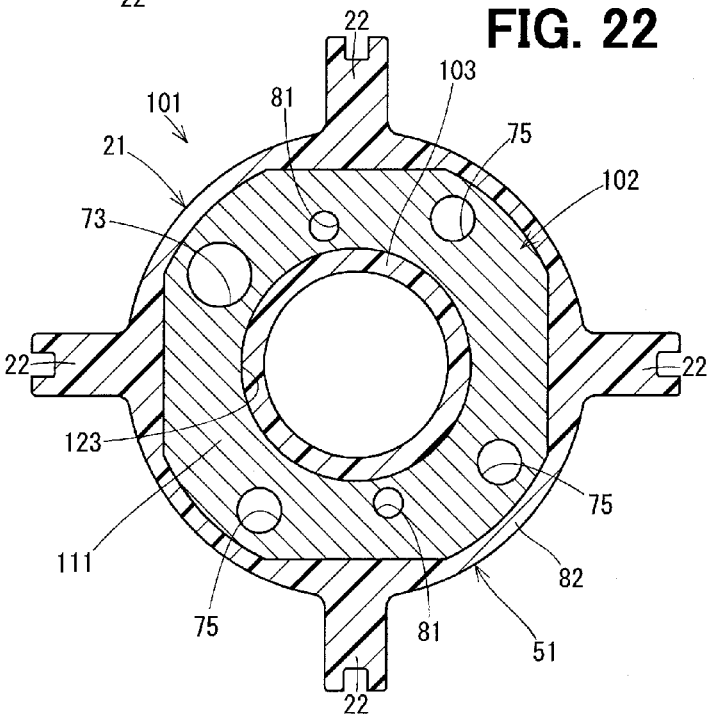
FIG. 22 is a cross-sectional view of the vane rotor of FIG. 14, which is taken at an axial position that coincides with a sixteenth metal plate of the laminated portion.
Figure 23:
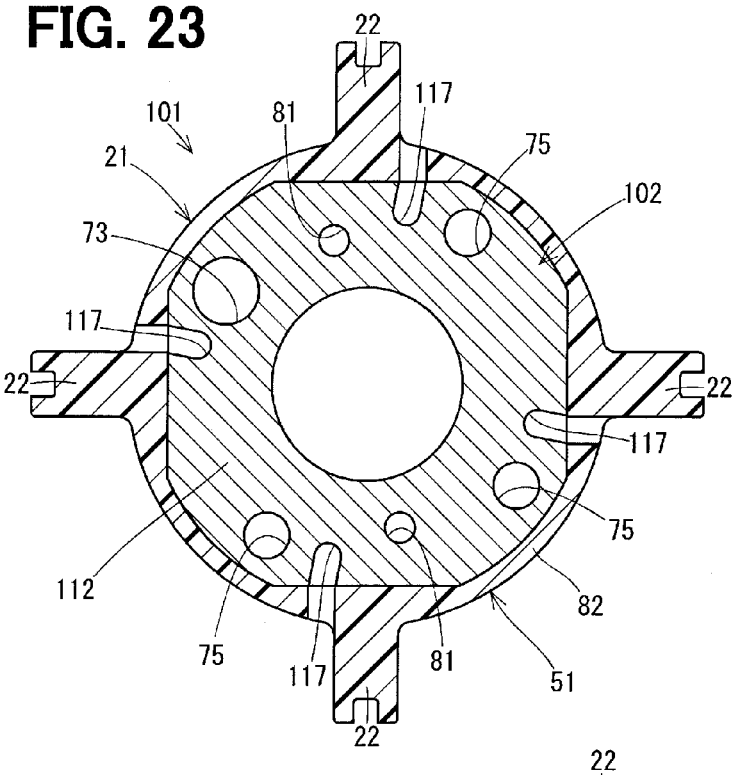
FIG. 23 is a cross-sectional view of the vane rotor of FIG. 14, which is taken at an axial position that coincides with a seventeenth metal plate of the laminated portion.
Figure 24:
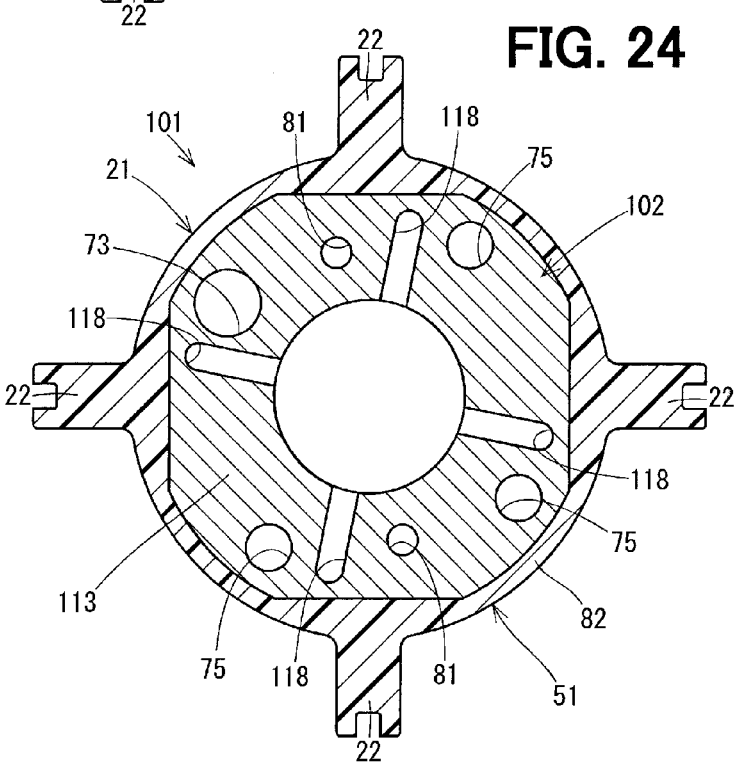
FIG. 24 is a cross-sectional view of the vane rotor of FIG. 14, which is taken at an axial position that coincides with an eighteenth metal plate of the laminated portion.

20, a metal plate 59 shown in FIG. 8, a metal plate 63 shown in FIG. 10, a metal plate 109 shown in FIG. 21, a metal plate 111 shown in FIG. 22, a metal plate 112 shown in FIG. 23, a metal plate 113 shown in FIG. 24, a metal plate 109, a metal plate 111, and two metal plates 64 shown in FIG. 11, which are stacked in this order in the axial direction.

In the following discussion, unless otherwise noted, the metal plates 54-55, 58-59, 63-64, 105-109, 111-113 will be simply referred to as metal plates.

Each axially adjacent two of the metal plates are assembled together by fitting recesses (not shown), which are formed in one of the axially adjacent two metal plates, into protrusions (not shown), which are formed in the other one of the axially adjacent two metal plates.

As shown in FIG. 17, the metal plate 105 includes a receiving hole 73, three press fitting holes 75, four advancing side through-holes 77, and four through-hole forming notches 115. Each through-hole forming notch 115 radially inwardly extends from an outer peripheral edge of the metal plate 105 and forms a through-hole 114. In the metal plate 105, the through-hole forming notches 115 are arranged one after another at equal intervals in the circumferential direction.

As shown in FIG. 18, the metal plate 106 includes a receiving hole 73, three press fitting holes 75, and four advancing side through-holes 77. An inner peripheral edge 121 of the metal plate 106 is placed on a radially outer side of a radially inner end of each of the through-hole forming notches 115 of the metal plate 105 of FIG. 17. Thereby, when the metal plates are stacked, a space, which is located on a radially inner side of the metal plate 106, is communicated with the through-hole forming notches 115 of the metal plate 105.

As shown in FIG. 19, the metal plate 107 includes a receiving hole 73, three press fitting holes 75, and four through-hole forming notches 115.

Figure 20:
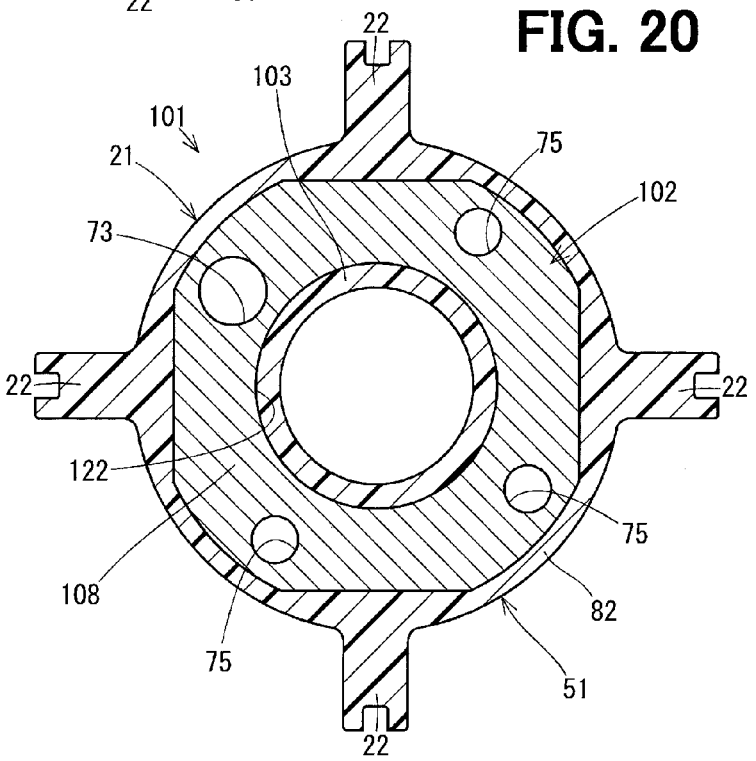
FIG. 20 is a cross-sectional view of the vane rotor of FIG. 14, which is taken at an axial position that coincides with a fourteenth metal plate of the laminated portion.

As shown in FIG. 20, the metal plate 108 includes a receiving hole 73 and three press fitting holes 75. An inner peripheral edge 122 of the metal plate 108 is located on a radially outer side of a radially inner end of each of the through-hole forming notches 115 of the metal plate 107 of FIG. 19. Thereby, when the metal plates are stacked, a space, which is located on a radially inner side of the metal plate 108, is communicated with the through-hole forming notches 115 of the metal plate 107.

As shown in FIG. 21, the metal plate 109 includes a receiving hole 73, three press fitting holes 75, four through-hole forming notches 115, and two supply through-holes 81.

As shown in FIG. 22, the metal plate 111 includes a receiving hole 73, three press fitting holes 75, and two supply through-holes 81. An inner peripheral edge 123 of the metal plate 111 is located on a radially outer side of a radially inner end of each of the through-hole forming notches 115 of the metal plate 109 of FIG. 21. Thereby, when the metal plates are stacked, a space, which is located on a radially inner side of the metal plate 111, is communicated with the through-hole forming notches 115 of the metal plate 109.

As shown in FIG. 23, the metal plate 112 includes a receiving hole 73, three press fitting holes 75, two supply through-holes 81, and four primary retarding side notches 117. Each of the primary retarding side notches 117 radially inwardly extends from an outer peripheral edge of the metal plate 112 and forms a portion of the retarding oil passage 28.

As shown in FIG. 24, the metal plate 113 includes a receiving hole 73, three press fitting holes 75, two supply through-holes 81, and four secondary retarding side notches 118. Each of the secondary retarding side notches 118 radially outwardly extends from an inner peripheral edge of the metal plate 113 and forms a portion of the retarding oil passage 28. A radially outer end part of each secondary retarding side notch 118 is formed in a corresponding location, which coincides with a radially inner end part of the corresponding primary retarding side notch 117 in a view taken in the axial direction.

An outer peripheral surface of each seal portion 103 contacts an inner peripheral wall surface of the laminated portion 102. The four seal portions 103 include first to fourth seal portions 103, which are arranged one after another in this order in the axial direction from the head 33 side. Thereby, as shown in FIG. 18, the first seal portion 103 contacts the inner peripheral edge 121 of the metal plate 106. As shown in FIG. 20, the second seal portion 103 contacts the inner peripheral edge 122 of the metal plate 108. As shown in FIG. 22, the third seal portion 103 contacts the inner peripheral edge 123 of the metal plate 111. Similar to the third seal portion 103, the fourth seal portion 103 contacts the inner peripheral edge 123 of the metal plate 111.

As shown in FIGS. 15 and 16, the laminated portion 102 includes a plurality of through-holes 114, each of which extends from the outer peripheral wall surface of the laminated portion 102 to the corresponding seal portion 103. In the present embodiment, the through-holes 114 are defined by the through-hole forming notches 115 of the metal plates 105, 107, 109. As shown in FIGS. 17, 19, and 21, corresponding four of the through-holes 114, which are placed at the same axial position (common axial position), are arranged one after another at equal intervals in the circumferential direction. Also, as shown in in FIGS. 17, 19, and 21, a corresponding portion of the metal plate 105, 107, 109 is circumferentially placed between each circumferentially adjacent two of the through-holes 114, which are placed at the same axial position (common axial position). Furthermore, the number of the through-holes 114 located at the same axial position (common axial position) is equal to the number (four in this embodiment) of the vanes 22. Each of the vanes 22 is interposed between corresponding circumferentially adjacent two of the through-holes 114, which are placed in the same axial position (common axial position). The metal plates 105, 107, 109 serve as primary metal plates of the present disclosure, and the metal plates 106, 108, 111 serve as secondary metal plates of the present disclosure.

As shown in FIGS. 16, 17, 19, and 21, each of the connecting portions 104 is formed to extend from the tubular portion 82 of the molding portion 51 to the corresponding seal portion 103 through the corresponding through-hole 114.

The molding portion 51, the seal portions 103 and the connecting portions 104 are integrally formed as a common member (single member) and are made of a material, which has a thermal expansion coefficient that is larger than a thermal expansion coefficient of each metal plate. In the present embodiment, the molding portion 51, the seal portions 103 and the connecting portions 104 are made of resin and are molded through a process of filling molten resin into a metal mold, in which the laminated portion 102 is set, and a process of solidifying the molten resin filled in the metal mold.

As discussed above, in the second embodiment, the vane rotor 101 includes the laminated portion 102 and the seal portions 103. Each of the seal portions 103 contacts the inner peripheral wall surface of the laminated portion 102 along an entire circumferential extent of the seal portion 103 to limit radially outward deformation of the seal portion 103, and each of the seal portions 103 is made of resin, which has a thermal expansion coefficient that is larger than a thermal expansion coefficient of each metal plate.

Therefore, according to the second embodiment, when each corresponding portion of the valve timing adjusting apparatus 100 undergoes the thermal expansion during the operational process that causes the high temperature of the corresponding portion of the valve timing adjusting apparatus 100, a clearance between each seal portion 103 of the vane rotor 101 and the sleeve 35 is reduced, and thereby a sealing performance between the ports of the sleeve 35 is improved. Therefore, the deterioration of the operational speed of the vane rotor 101 can be limited, and the deterioration of the holdability of the rotational phase of the vane rotor 101 relative to the housing 10 can be limited.

Furthermore, in the second embodiment, the metal plates of the laminated portion 102 of the vane rotor 101 include the metal plates (the primary metal plates) 105, 107, 109 and the metal plates (the secondary metal plates) 106, 108, 111. Each of the metal plates 105, 107, 109 includes the through-hole forming notches 115, each of which radially inwardly extends from the outer peripheral edge of the metal plate 105, 107, 109 and forms the corresponding through-hole 114. Each of the metal plates 106, 108, 111 is placed adjacent to the corresponding one of the metal plates 105, 107, 109 and is formed on the radially outer side of the corresponding seal portion 103. Furthermore, each of the metal plates 106, 108, 111 has the inner peripheral edge 121, 122, 123, which is located on the radially outer side of the radially inner ends of the through-hole forming notches 115.

Therefore, in the second embodiment, each metal plate 105, 107, 109, which is placed in the axial position that coincides with the axial position of the corresponding through-holes 114, is made as a single metal plate. Therefore, in contrast to the case of the first embodiment, in which the metal plates are divided in the circumferential direction, the work efficiency is better at the time of stacking the metal plates. Thus, the manufacturing of the laminated portion 50 can be eased.

Third Embodiment

A valve timing adjusting apparatus according to a third embodiment of the present disclosure will be described with reference to FIG. 25.

Figure 25:
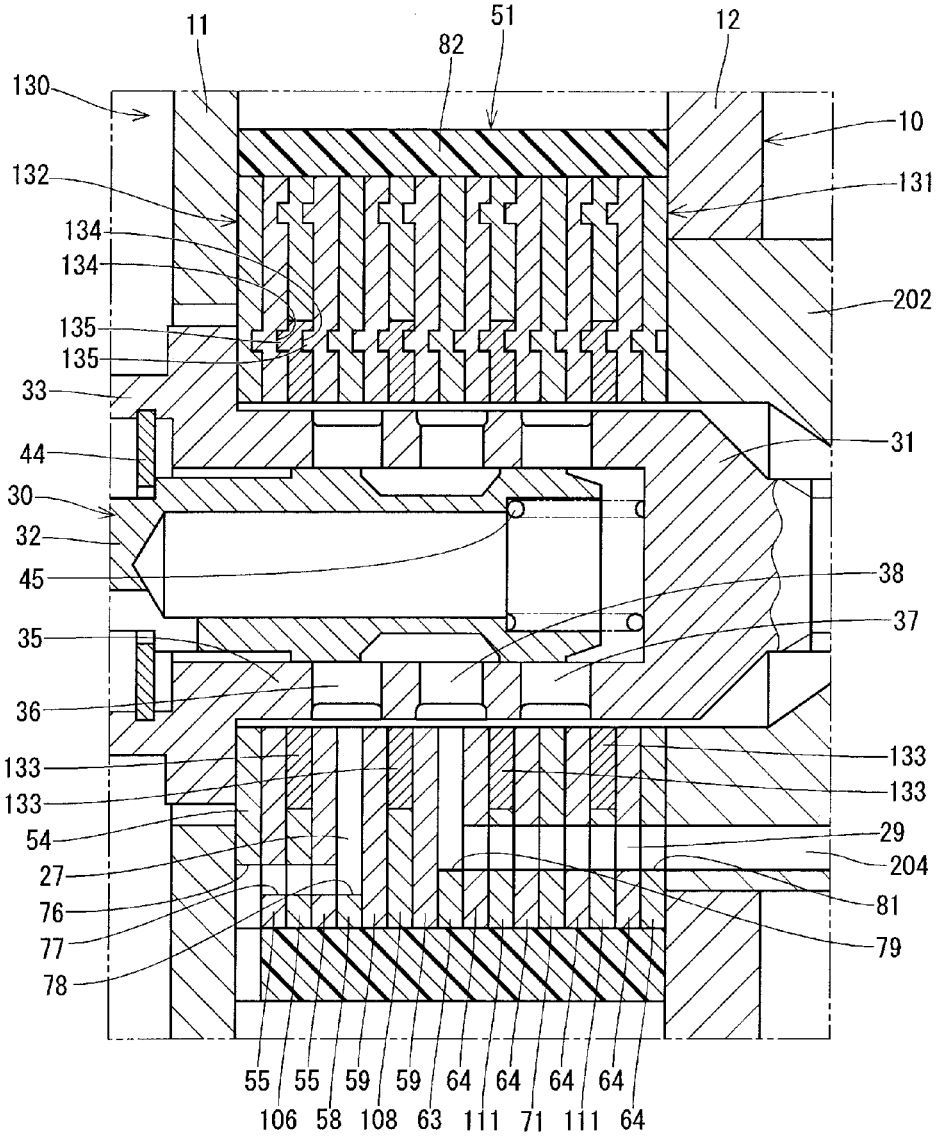
FIG. 25 is a cross-sectional view of a valve timing adjusting apparatus according to a third embodiment of the present disclosure.

As shown in FIG. 25, the valve timing adjusting apparatus 130 of the present embodiment includes a vane rotor 131, a laminated portion 132, a molding portion 51, and seal portions 133.

The laminated portion 132 includes a metal plate 54; a metal plate 55; a metal plate 106 and a seal portion 133 (more specifically, a set of a metal plate 106 and a seal portion 133 placed along a common plane); a metal plate 55; a metal plate 58; a metal plate 59; a metal plate 108 and a seal portion 133 (more specifically, a set of a metal plate 108 and a seal portion 133 placed along a common plane); a metal plate 59; a metal plate 63; a metal plate 64, a metal plate 111 and a seal portion 133 (more specifically, a set of a metal plate 111 and a seal portion 133 placed along a common plane); a metal plate 64; a metal plate 71; a metal plate 64; a metal plate 111 and a seal portion 133 (more specifically, a set of a metal plate 111 and a seal portion 133 placed along a common plane); and two metal plates 64, which are stacked in this order in the axial direction.

Each of the seal portions 133 is configured into an annular plate form (i.e., is formed as an annular plate), which extends in the circumferential direction along the outer peripheral surface of the sleeve 35. Corresponding two of the seal portions 133 are placed at two axial sides, respectively, of each of the advancing port 36, the retarding port 37, and the supply port 38 of the sleeve 35. In the present embodiment, the seal portions 133 are made of aluminum.

Each metal plate has a plurality of recesses 134, which are recessed on the one axial side. In each metal plate, the recesses 134 are arranged one after another at generally equal intervals in the circumferential direction. Furthermore, each of the metal places, which are other than the metal plate 54, has a plurality of protrusions 135, which protrude in the one axial side and are fitted into the recesses 134, respectively of the adjacent metal plate. In each of these metal plates, the protrusions 135 are arranged one after another at generally equal intervals in the circumferential direction. In FIG. 25, in order to avoid complication of the drawing, only two of the recesses are indicated by the reference numeral 134, and only two of the protrusions are indicated by the reference numeral 135.

The recesses 134 and the protrusions 135 are placed on a radially outer side of a radial center of a radial extent (radial width) of each seal portion 133. In this way, each seal portion 133 is fixed to and is engaged to the laminated portion 132 at a location, which is on the radially outer side of the radial center of the radial extent (radial width) of the seal portion 133.

As discussed above, in the third embodiment, the vane rotor 131 includes the laminated portion 132 and the seal portions 133. Each of the seal portions 133 is engaged with the laminated portion 132 through the engagement between the recesses 134 and the protrusions 135 to limit the radially outward deformation of the seal portion 133 and is made of aluminum, which has a thermal expansion coefficient that is larger than the thermal expansion coefficient of each metal plate.

Therefore, according to the third embodiment, similar to the first embodiment, the deterioration of the operational speed of the vane rotor 131 can be limited, and the deterioration of the holdability of the rotational phase of the vane rotor 131 relative to the housing 10 can be limited.

Furthermore, in the third embodiment, each of the seal portions 133 is configured into the annular plate form and is stacked between the corresponding metal plates of the laminated portion 132 in the axial direction.

Thus, each metal plate and each seal portion 133 can be assembled together in the same process (stacking process), and thereby the number of manufacturing processes can be reduced.

Furthermore, in the third embodiment, each of the seal portions 133 is fixed to the laminated portion 132 at the location, which is on the radially outer side of the radial center of the radial extent (radial width) of the seal portion 133.

Therefore, when each corresponding portion of the valve timing adjusting apparatus 130 undergoes the thermal expansion during the operational process that causes the high temperature of the corresponding portion of the valve timing adjusting apparatus 130, each seal portion 133 is deformed toward the radially inner side from the fixed point of the seal portion 133, which is located on the radially outer side of the seal portion 133. At this time, the amount of deformation of the seal portion toward the radially inner side is larger than the amount of deformation of the seal portion of the case where the radially inner side of the seal portion is fixed. Thus, the sealing performance for sealing between the ports of the sleeve 35 can be further improved.

Now, modifications of the above embodiments will be described.

In a modification of the above embodiment(s), the material of the seal portions is not limited to the resin. For instance, the seal portions may be alternatively made of any other appropriate non-metal material, such as rubber, or may be alternatively made of any other appropriate metal, such as aluminum, zinc, magnesium or the like. That is, it is only required to form the seal portions from the material, which has the thermal expansion coefficient that is larger than the thermal expansion coefficient of each metal plate.

In the third embodiment, each seal portion 133, which is configured into the annular plate form, is fixed to the adjacent metal plates through the engagement between the recesses 134 and the protrusions 135. In another modification of the above embodiments, each seal portion may be fixed to the laminated portion by any other appropriate manner, such as press fitting or welding.

In another modification of the above embodiment(s), the recesses and protrusions may be not arranged at equal intervals in the circumferential direction. It is only required to provide the recess and the protrusion at two circumferential locations, which are opposed to each other about the central axis of the vane rotor.

In another modification of the above embodiment(s), the through-holes of the laminated portion, which are placed at the same axial position (common axial position), may not be arranged at equal intervals in the circumferential direction.

In another modification of the above embodiment(s), at the laminated portion, only one through-hole (single through-hole) may be provided to each of the seal portions.

In another modification of the above embodiment(s), the number of the through-holes located at the same axial position (common axial position) may be different from the number of the vanes.

In another modification of the above embodiment(s), the circumferential locations of the vanes may coincide with the circumferential locations of the through-holes of the laminated portion.

In another modification of the above embodiment(s), the number of the vanes may be changed to three or less or may be changed to five or more. Furthermore, the vanes may not be arranged at equal intervals in the circumferential direction. Furthermore, the size of any one or more of the vanes may be different from the size of any other one or more of the vanes.

In another modification of the above embodiment(s), the valve timing adjusting apparatus may be a valve timing adjusting apparatus, which adjusts valve timing of exhaust valves of the internal combustion engine.

The present disclosure is not limited the above embodiments and modifications thereof. That is, the above embodiments and modifications thereof may be further modified in various ways without departing from the principle of the present disclosure.

What is claimed is:

1. A valve timing adjusting apparatus that is placed in a drive force transmission path for transmitting a drive force from a driving-side shaft of an internal combustion engine to a driven-side shaft and adjusts valve timing of at least one of an intake valve and an exhaust valve driven by the driven-side shaft, the valve timing adjusting apparatus comprising:

a housing that is rotatable integrally with one of the driving-side shaft and the driven-side shaft;

a vane rotor that is received in the housing and is rotatable integrally with the other one of the driving-side shaft and the driven-side shaft, wherein the vane rotor has a vane, which partitions a corresponding inner space of the housing into an advancing chamber and a retarding chamber, and the vane rotor includes:

an advancing oil passage that is communicated with the advancing chamber;

a retarding oil passage that is communicated with the retarding chamber; and a supply oil passage that is communicatable with an external oil supply source;

a sleeve that is configured into a tubular form and extends in an axial direction at a center portion of the vane rotor, wherein the sleeve includes:

an advancing port that is communicated with the advancing oil passage;

a retarding port that is communicated with the retarding oil passage; and a supply port that is communicated with the supply oil passage; and a spool that is displaceable in the axial direction in an inside of the sleeve, wherein the spool connects between the supply port and the advancing port when the vane rotor is rotated to an advancing side relative to the housing, and the spool connects between the supply port and the retarding port when the vane rotor is rotated to a retarding side relative to the housing, wherein:

the vane rotor includes:

a laminated portion that includes a plurality of metal plates, which are stacked in the axial direction; and a seal portion that is placed on at least one of two axially opposite sides of at least one of the advancing port, the retarding port, and the supply port and is configured into an annular form to extend along an outer peripheral surface of the sleeve in a circumferential direction, wherein the seal portion is engaged with the laminated portion to limit displacement or deformation of the seal portion toward a radially outer side and is made of a material that has a thermal expansion coefficient, which is larger than a thermal expansion coefficient of a material of each of the plurality of metal plates.

2. The valve timing adjusting apparatus according to claim 1, wherein:

the laminated portion of the vane rotor includes a through-hole that extends from an outer peripheral wall surface of the laminated portion to the seal portion; and the vane rotor includes:

a molding portion that is molded to surround the outer peripheral wall surface of the laminated portion; and a connecting portion that extends from the molding portion to the seal portion through the through-hole.

3. The valve timing adjusting apparatus according to claim 2, wherein:

the through-hole is one of a plurality of through-holes, which are formed in the laminated portion and radially extend from the seal portion of the vane rotor; and at least a portion of a corresponding one of the plurality of metal plates is circumferentially placed between each circumferentially adjacent two of the plurality of through-holes, which are placed at a common axial position.

4. The valve timing adjusting apparatus according to claim 3, wherein:

the vane is one of a plurality of vanes of the vane rotor;

each of the plurality of vanes is circumferentially placed between corresponding circumferentially adjacent two of the plurality of through-holes, which are placed at the common axial position.

5. The valve timing adjusting apparatus according to claim 4, wherein the number of the plurality of through-holes, which are placed at the common axial position, is equal to the number of the plurality of vanes.

6. The valve timing adjusting apparatus according to claim 2, wherein the plurality of metal plates includes:

a primary metal plate that includes a through-hole forming notch, which radially inwardly extends from an outer peripheral edge of the primary metal plate and forms the through-hole; and a secondary metal plate that is placed adjacent to the primary metal plate in the axial direction and is located on a radially outer side of the seal portion of the vane rotor while an inner peripheral edge of the secondary metal plate is placed on a radially outer side of a radially inner end of the through-hole forming notch.

7. The valve timing adjusting apparatus according to claim 1, wherein the seal portion is formed as an annular plate and is stacked between corresponding adjacent two of the plurality of metal plates in the axial direction.

8. The valve timing adjusting apparatus according to claim 7, wherein the seal portion is fixed to the laminated portion at a location, which is on a radially outer side of a radial center of a radial width of the seal portion.

* * * * *